US006769437B2

(12) United States Patent
Hajaligol et al.

(10) Patent No.: US 6,769,437 B2
(45) Date of Patent: Aug. 3, 2004

(54) USE OF OXYHYDROXIDE COMPOUNDS FOR REDUCING CARBON MONOXIDE IN THE MAINSTREAM SMOKE OF A CIGARETTE

(75) Inventors: Mohammad Hajaligol, Midlothian, VA (US); Ping Li, Chesterfield, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 10/117,220

(22) Filed: Apr. 8, 2002

(65) Prior Publication Data

US 2003/0188758 A1 Oct. 9, 2003

(51) Int. Cl.[7] ..... A24B 15/00

(52) U.S. Cl. ..... 131/364; 131/352

(58) Field of Search ..... 131/328, 360, 131/361, 362–364, 347, 352

(56) References Cited

U.S. PATENT DOCUMENTS

| | | | |
|---|---|---|---|
| 3,127,901 | A | 4/1964 | Whitefield et al. |
| 3,545,448 | A | 12/1970 | Troon et al. |
| 3,638,660 | A | 2/1972 | Davis |
| 3,720,214 | A | 3/1973 | Norman et al. |
| 3,807,416 | A | 4/1974 | Hedge et al. |

(List continued on next page.)

FOREIGN PATENT DOCUMENTS

| | | |
|---|---|---|
| CH | 609217 | 2/1979 |
| DE | 3600462 A1 | 7/1987 |

(List continued on next page.)

OTHER PUBLICATIONS

Table of Physical Constant of Inorganic Compounds: Ferric Oxide obtained from CRC Handbook of Chemistry and Physics (3 Electronic Edition), retrieved from http://www.knovel.com/knovel2/SearchResults.jsp on Jun. 13, 2003.*

(List continued on next page.)

*Primary Examiner*—Steven P. Griffin
*Assistant Examiner*—Carlos Lopez
(74) *Attorney, Agent, or Firm*—Burns, Doane, Swecker & Mathis, LLP

(57) ABSTRACT

Cut filler compositions, cigarettes, methods for making cigarettes and methods for smoking cigarettes are provided, which involve the use of an oxyhydroxide compound that is capable of decomposing to form at least one product capable of acting as an oxidant for the conversion of carbon monoxide to carbon dioxide and/or as a catalyst for the conversion of carbon monoxide to carbon dioxide. The oxyhydroxide compound and/or the product formed from the decomposition of the oxyhydroxide can be in the form of nanoparticles. Cut filler compositions are described which comprise tobacco and at least one such oxyhydroxide compound. Cigarettes are provided, which comprise a tobacco rod, containing a cut filler having at least one such oxyhydroxide compound. Methods for making a cigarette are provided, which involve (i) adding at least one such oxyhydroxide compound to a cut filler; (ii) providing the cut filler comprising the oxyhydroxide compound to a cigarette making machine to form a tobacco rod; and (iii) placing a paper wrapper around the tobacco rod to form the cigarette. Methods of smoking the cigarette, as described above, are also provided, which involve lighting the cigarette to form smoke and inhaling the smoke, wherein during the smoking of the cigarette, the oxyhydroxide compound decomposes during smoking to form a compound that acts as an oxidant for the conversion of carbon monoxide to carbon dioxide and/or as a catalyst for the conversion of carbon monoxide to carbon dioxide.

15 Claims, 23 Drawing Sheets

U.S. PATENT DOCUMENTS

| | | | | | |
|---|---|---|---|---|---|
| 3,874,390 | A | | 4/1975 | Eicher et al. | |
| 3,931,824 | A | | 1/1976 | Miano et al. | |
| 4,109,663 | A | | 8/1978 | Maeda et al. | |
| 4,119,104 | A | | 10/1978 | Roth | |
| 4,149,549 | A | | 4/1979 | Grossman et al. | |
| 4,193,412 | A | | 3/1980 | Heim et al. | |
| 4,195,645 | A | | 4/1980 | Bradley et al. | |
| 4,197,861 | A | | 4/1980 | Keith | |
| 4,296,762 | A | | 10/1981 | Eicher et al. | |
| 4,317,460 | A | | 3/1982 | Dale et al. | |
| RE31,700 | E | | 10/1984 | Yamaguchi | |
| 4,874,000 | A | * | 10/1989 | Tamol et al. | 131/375 |
| 4,956,330 | A | | 9/1990 | Elliott et al. | |
| 5,050,621 | A | | 9/1991 | Creighton et al. | |
| 5,074,321 | A | * | 12/1991 | Gentry et al. | 131/360 |
| 5,101,839 | A | | 4/1992 | Jakob et al. | |
| 5,105,836 | A | | 4/1992 | Gentry et al. | |
| 5,129,408 | A | | 7/1992 | Jakob et al. | |
| 5,258,340 | A | | 11/1993 | Augustine et al. | |
| 5,386,838 | A | | 2/1995 | Quincy et al. | |
| 5,598,868 | A | | 2/1997 | Jakob et al. | |
| 6,095,152 | A | | 8/2000 | Beven et al. | |
| 6,342,191 | B1 | * | 1/2002 | Kepner et al. | 423/210 |
| 2002/0195115 | A1 | * | 12/2002 | Meier | 131/347 |
| 2003/0005940 | A1 | * | 1/2003 | Dyakonov et al. | 131/202 |

FOREIGN PATENT DOCUMENTS

| | | | | | |
|---|---|---|---|---|---|
| DE | 3640953 | A1 | | 6/1988 | |
| GB | 562786 | | | 7/1944 | |
| GB | 685822 | | | 1/1953 | |
| GB | 863287 | | | 3/1961 | |
| GB | 908773 | | | 10/1962 | |
| GB | 914355 | | | 1/1963 | |
| GB | 973854 | | | 10/1964 | |
| GB | 1104993 | | | 3/1968 | |
| GB | 1113979 | | | 5/1968 | |
| GB | 1315287 | | | 5/1973 | |
| JP | 06105675 | A | * | 4/1994 | A24D/3/16 |
| WO | WO87/06104 | | | 10/1987 | |
| WO | WO 00/40104 | | | 7/2000 | |

OTHER PUBLICATIONS

Sakai et al., Thermal Decarbonylation of Catechol, Hydroquinone and Resolsinol, *Chemistry Letters,* 1976, pp. 1153–1156, Chemical Society of Japan.

Nilsson et al., Direct Probing of the Adsorbate–Substrate Chemical bond Using angle–Dependent X–Ray–Emission Spectroscopy, *Physical Review B,* Apr. 15, 1995, pp. 10 244–10–247, vol. 51, No. 15, The American Physical Society, USA.

Schlotzhauer et al., Pyrolytic Evaluation of Low Chlorogenic Acid Tobacco in the Formation of the Tobacco Smoke co–Carcinogen Catechol, *Journal of Analytical & Applied Pyrolysis,* 1992, pp. 231–238, vol. 22, Elsevier Science, Amsterdam, Netherlands.

Schlotzhauer et al., Pyrolytic Studies on the Origin of Phenolic Compounds in Tobacco Smoke, *Tobacco Science,* 1981, pp. 6–10, vol. 25, Tobacco Science, USA.

Feng et al., Agglomeration and Phase Transition of a Nanophase Iron Oxide Catalyst, *Journal of Catalysis,* 1993, pp. 510–519, vol. 143, Academic Press, Inc., San Diego, CA, USA.

Scholotzhauer et al., Pyrolytic Studies on the Contribution of Tobacco Leaf Constituents to the Formation of Smoke Catechols, *Agric. Food Chem.,* 1982, pp. 372–374, vol. 30, Amer. Chem. Society, Washington, D.C., USA.

Carmella et al., Roles of Tobacco Cellulose, sugars, and Chlorogenic Acid as Precursors to Catechol in Cigarette Smoke, *Agric. Food Chem.,* 1984, pp. 267–273, vol. 32, Amer. Chem. Society, Washington DC, USA.

Sharma et al., Effect of Reaction Conditions on Pyrolysis of Chlorogenic Acid, Journal Of Analytical and Applied Pyrolysis, 2002, pp. 281–296, vol. 62, Elsevier, England.

Sakuma et al., Pyrolysis of Chlorogenic Acid and Rutin, Agric. Biol. Chem., 1982, pp. 1311–1317, vol. 46, Agricultural Chemical Society of Japan, Tokyo, Japan.

Zhao et al., Structure of a Nanophase Iron Oxide Catalyst, Journal of Catalysis, 1993, pp. 499–509, vol. 143, Academic Press, Inc. , New York, USA.

Ellig et al., Pyrolysis of Volatile Aromatic Hydrocarbons and n–Heptane over Calcium Oxide and Quartz, Ind. Eng. Chem. Process Des. Dev., 1985, pp. 1080–1087, vol. 24, American Chemical Society, Washington, DC, USA.

Smith et al., The Relative Toxicity of Substituted Phenols Reported in Cigarett Mainstream Smoke, Toxicological Sciences, 2002, pp. 265–278, vol. 69, Society of Toxicology, Oxford Univ Press, Oxford, England.

Hopkinson et al., Nonlinear Island Growth Dynamics in Adsorbate–Induced Restructuring of Quasihexogonal Reconstructed Pt(100) by CO, Physical Review Letters, 1993, pp. 1597–1600, vol. 71, No. 10, American Physical Society, USA.

Yeo et al., Calorimetric Measurement of the Energy Difference Between Two Solid Surface Phases, Science, 1995, pp. 1731–1732, vol. 268.

Gruyters et al., Modeling Temporal Kinetic Oscillations for CO Oxidation on Pt(100) The (1x1)–CO Island Growth Rate Power Law Model, Chemical Physics Letters, 1995, pp. 1–6, vol. 232, Elsevier Science, Oxford, England.

Cant et al., Silver and Gold Catalyzed Reacton of Carbon Monoxide with Nitric Oxide and with Oxygen, Journal of Catalysis, 1975, pp. 531–539, vol. 37, Academic Press, Inc., USA.

Xia et al., Efficient Stable Catalysts for Low Temperature Carbon Monoxide Oxidation, Journal of Catalysis, 1999, pp. 91–105, vol. 185, Academic Press, Inc. USA.

Haruta et al., Gold Catalysts Prepared by Coprecipitation for Low–Temperature Oxidation of Hydrogen and of Carbon Monoxide, Journal of Catalysis, 1989, pp. 301–309, vol. 115, Academic Press Inc., USA.

Randall et al., Reduction of Nitrogen Oxides by Carbon Monoxide Over an Iron Oxide Catalyst Under Dynamic Conditions, Applied Catalysis B: Environmental, 1988, pp. 357–369, Vo 17, Elsevier Science, England.

Lanzillotti et al., One–Dimensional Gas Concentration Profiles Within a Burning Cigarette During a Puff, Beitrage zur Tabakforschung, 1975, pp. 219–224, Band 8, Heft 4.

Li et al., The Removal of Carbon Monoxide by Iron Oxide Nanoparticles, Applied Catalysis B: Environmental, 2002, pp. 1–12, vol. 1326, Elsevier Science, England.

Baker et al., The Formation of the Oxides of Carbon by the Pyrolysis of tobacco, Beitrage zur Tabakforschung, 1975, pp. 16–27, Band 8, Heft 1.

Shen et al., Cu Containing Octahedral Molecular Sieves and Octahedral Layered Materials, Journal of Catalysis, 1996, pp. 115–122, vol. 161, Academic Press, Inc., USA.

Brageet al., Tar Evolution Profiles Obtained from Gasification of Biomass and Coal, Biomass & Bioenergy, 2000, pp. 87–91, vol. 18, Elsevier, England.

Brage et al., Characteristics of Evolution of Tar from Wood Pyrolysis in a Fixed–Bed Reactor, Fuel, 1996, pp. 213–219, vol. 75, No. 2, Elsevier Sci Ltd., England.
Rath et al., Tar Cracking from Fast Pyrolysis of Large Beech Wood Particles, Journal of Analytical & Applied Pyrolysis, 2002, pp. 83–92, vol. 62, Elsevier, England.
Hasler et al., Sampling and Analysis of Particles and Tars from Biomass Gasifiers, Biomass & Bioenergy, 2000, pp. 61–66, vol. 18, Elsevier, England.
Wornat et al., Polycyclic Aromatic Hydrocarbons from the Pyrolysis of Catechol (ortho–dihydroxybenzene), a Model Fuel Representative of Entities in Tobacco, Coal & Lignin, Fuel, 2001, pp. 1711–1726, vol. 80, Elsevier, England.
Windig, Chemical Interpretation of Differences in Pyrolysis–Mass Spectra of Simulated Mixtures of Biopolymers by Factor Analysis with Graphical Rotation, Journal of Analytical & Applied Pyrolysis, 1981/1982, pp. 199–212, vol. 3, Elsevier Scientific Pub. Co., Amsterdam, Netherlands.
Walker et al., Carbon Monoxide & Propene Oxidation by Iron Oxides for Auto–Emission Control, Journal of Catalysis, 1988, pp. 298–309, vol. 110, Academic Press, Inc., USA.
Colussi et al., The Very Low–Pressure Pyrolysis of Phenyl Ethyl Ether, Phenyl Allyl Ether, & Benzyl Methyl Ether And the Enthalpy of Formation of the Phenoxy Radical, Intl Journal of Chemical Kinetics, 1977, pp. 161–178, vol. IX, John Wiley & Sons, Inc., New York, USA.
Windig et al., Interactive Self–Modeling Multivariate Analysis, Chemometrics & Intelligent Laboratory Systems, 1990, pp. 7–30, vol. 9, Elsevier Sci Pub., B.V., Amsterdam, Netherlands.
Lovell et al., The Gas Phase Pyrolysis of Phenol, Intl Journal of Chemical Kinetics, 1989, pp. 547–560, vol. 21, John Wiley & Sons, Inc., New York, USA.
Rath et al., Cracking Reaction of Tar form Pyrolysis of Spruce Woods, Fuel, 2001, pp. 1379–1389, vol. 80, Elsevier Science Ltd, England.
Wong et al., In–Situ Study of MCM–41 Supported Iron Oxide Catalysts by XANES & EXAFS, Applied Catalysis A: General, 2000, pp. 115–126, vol. 198, Elsevier Science B.V., England.
Haruta et al., Synergism in the Catalysis of Supported Gold, New Aspects of Spill over Effect in Catalysis, 1993, pp. 45–52, Elsevier Science Publishers B.V., England.
Fohlisch et al., The Bonding of CO to Metal Surfaces, Journal of Chemical Physics, 2000, pp. 1946–1958, vol. 112, No. 4, American Institute of Physics, Melville, New York, USA.
Hauert et al., CO Adsorption on Glassy $Ni_{64}Zr_{38}$ and Polycrystalline $Ni_3r$, Rapidly Quenched Metals, 1985, pp. 1493–1496, Elsevier Science Publishers B.V., England.
Baiker, Glassy metals in Catalysis, Topics in Applied Physics, 1994, pp. 122–162, vol. 72, Springer–Verlag Berlin Heidelberg, Germany.
Haruta et al., Preparation of Highly Active Composite Oxides of Silver for Hydogen and Carbon Monoxide Oxidation, Preparation of Catalysts I II, 1983, pp. 225–236, Elsevier Science Pub. B.V., Amsterdam, Netherlands.
Shin et al., The Formation of Aromatics from the Gas–Phase Pyrolysis of Stigmasterol: Kinetics, Fuel, 2001, pp. 1681–1687, vol. 80, Elsevier Science Ltd., England.
Yeboah et al., Pyrolytic Desulfurization of Coal in Fluidized Beds of Calcined dolomite Ind. Eng. Chemical Process Des. Dev., 1982, pp. 324–330, vol. 21, American Chemial Society, USA.
Galvagno et al., Oxygen Transfer Between Co & $CO_2$ Catalyzed by Supported Au, Pt, and Au–Pt, Ber. Bunsenges Phys. Chem., 1979, pp. 894–899, vol. 83, Verlag Chemie, Germany.
Cha et al., Surface Reactivity of Supported Gold, Journal of Catalysis, 1970, pp. 200–211, vol. 18, Academic Press, New York, NY, USA.
Baiker et al., Transformation of Glassy Palladium–Zirconium Alloys to Highly active C0–Oxidation Catalysis During in Situ Activation Studied by Thermoanalytical Methods & X–Ray Diffraction, Ber. Bunsenges Phys Chem. 1993, pp. 266–292, vol. 97, No. 3, VCH Verlagsgesellschaft mbH, Weinheim, Germany.
Blyholder, Molecular Orbital View of Chemisorbed Carbon Monoxide, Journal of Physical Chemistry, 1964, pp. 2772–2778, vol. 68, No. 10, American Chemical Society, USA.
Nilsson et al., An Atom–Specific Look at the Surface Chemical Bond, Physical Review Letters, 1997, pp. 2847–2850, vol. 78, No. 14, American Chemical Society, USA.
Evans et al., Molecular Characterization of the Pyrolysis of Biomass. 1. Fundamentals, Energy & Fuels, 1987, pp. 13–127, vol. 1, No. 2, American Chemical Society, USA.
Fohlisch et al., How Carbon Monoxide Adsorbs in Different Sites, Physical Review Letters, 2000, pp. 3309–3312, vol. 85, No. 15, American Physical Society, USA.
Fohlisch et al., Ground–State interpretation of X–Ray Emission Spectroscopy on Adsorbates: CO Adsorbed on Cu(100), Physical Review B, 2000, pp. 16229–16240, vol. 61, No. 23, American Physical Society, USA.
Baker, B., Combustion and Thermal Decomposition Regions Inside a Burning cigarette, Combustion and Flame, 1977, pp. 21–32, vol. 30, Combustion Institute, Elsevier North–Holland, Inc., Amsterdam, Holland.
Gardner et al., Catalytic Behavior of Nobel Metal/Reducible Oxide Materials for Low–Temperature Co Oxidation. 1. Comparison of Catalyst Performance, Langmuir, 1991, pp. 2135–2139, vol. 7, American Chemical Society, USA.
Daglish et al., The Carbon Monoxide–oxygen Reaction on Palladium Gold Alloys, Proceedings of $2^{nd}$ Intl congress of Catalysis, 1961, pp. 1615–1626, Chapter 79.
Yeboah et al., Effect of Calcined Dolomite on the Fluidized Bed Pyolysis of Coal, Ing. Eng. Chem. Process Des. Dev., 1980, pp. 646–653, vol. 19, American Chemical Society.
Chen, J., NEXAFS Investigations of Transition Metal Oxides, Nitrides, Carbides, Sulfides & Other Interstitial Compounds, Surface Science Reports, 1997, pp. 1–152, vol. 30, Elsevier Science B.V., Amsterdam, Holland.
Shin et al., A Study of the Mechanisms of Vanillin Pyrolysis by Mass Spectrometry & Multivariate Anaylsis, Fuel, 2001, pp. 1689–1696, vol. 80, Elsevier Science Ltd.
Shin et al., Kinetic Analysis of the Gas–Phase Pyrolysis of Carbohydrates, Fuel, 2001, pp. 1697–1709, vol. 80, Elsevier Science Ltd.
Hesp et al., Thermal Cracking of Tars & Volatile Matter from Coal Carbonization, Ind. Eng. Chem. Prod. Res. Develop, 1970, pp. 194–202, vol. 9, No. 2, American Chemical Society.
He et al., Kinetics of Hydrogen & Hydroxyl Radical Attack on Phenol at High Temperatures, Journal Physical Chemistry, 1988, pp. 2196–2201, vol. 92, American Chemical Society, USA.

Cypres et al., Mecanismes De Fragmentation Pyrolytique Du Phenol Et Des Cresols, Terahedron, 1974, pp. 1253–1260, vol. 30, Pergamon Press, Great Britain.

Cypres et al., Pyrolyse Themique des [$^{14}$C]ET[$^{3}$H]. Ortho Et Para–Cresols, Tetrahedron, 1975, pp. 353–357, vol. 31, Pergamon Press, Great Britain.

Windig et al., Nonsupervised Numerical Component Extraction from Pyrolysis Mass Spectra of Complex Mixtures, Analytical Chemistry, 1984, pp. 2297–2303, vol. 56, American Chemical Society, USA.

Windig et al., Interpretation of Sets of Pyrolysis Mass Spectra by Discriminant Analysis & Graphical Rotation, Analytical Chemistry, 1983, pp. 81–88, vol. 55, American Chemical Society, USA.

Tillborg et al., Studies of the Co–H,H2–Ni(100) system Using Photoelectron Spectroscopy, Surface Science, 1992, pp. 47–60, vol. 273, Elsevier Science Publishers B.V., England.

Westerlund et al., Hydrogen Recombination & Σ–Desorption from the Ni(100)–H–CO Coadsorption System, Surface Science, 1998, pp. 109–120, vol. 199, Elsevier Science Publishers B.V. North–Holland Physics Publishing Division, Holland.

Imamura et al., Oxidation of Carbon Monoxide Catalyzed by Manganese–silver Composite Oxides, Journal of Catalysis, 1988, pp. 198–205, vol. 109, Academic Press, Inc., New York, USA.

Haruta et al., Gold Catalysts Prepared by Coprecipitation for Low–Temperature Oxidation of Hydrogen and of Carbon Monoxide, Journal of Catalysis, 1998, pp. 301–309, vol. 115, Academic Press, Inc., New York, USA.

Imamura et al., Cooperative Action of Palladium and Managanese(III) Oxide in the Oxidation of Carbon Monoxide, Journal of Catalysis, 1995, pp. 279–284, vol. 151, Academic Press, Inc., New York, USA.

Kim et al., Controlling Chemical Turbulence by Global Delayed Feedback: Pattern Formation in Catalytic CO Oxidation on Pt(110), Science, 2001, pp. 1357–1360, vol. 292, Science Magazine.

Boccuzzi et al., FTIR Study of CO Oxidation on Au/$TIO_2$ at 90 K and Room Temperature. An Insight into the Nature of the Reaction Centers, Journal of Physical Chemistry B, 2000, pp. 5414–5416, vol. 104, American Chemical Society, USA.

Baiker et al., Carbon Monoxide Oxidation over Catalyst Prepared by in Situ Activation of Amorphous Gold–silver–Zirconium and Gold–Iron–Zirconium Alloys, Journal of Catalysis, 1995, pp. 407–419, vol. 151, Academic Press, Inc., USA.

Haruta et al., Low–Temperature Oxidation of CO over Gold Supported on $TiO_2$,∝–Fe $_2O_4$ and $Co_3O_4$, Journal of Catalysis, 1993, pp. 175–192, vol. 144, Academic Press, Inc., USA.

Kobayashi et al., A Selective CO Sensor Using Ti–Doped a$Fe_2O_3$ with Coprecipitated Ultrafine Particles of Gold, Sensors and Actuators, 1988, pp. 339–349, vol. 13, Elsevier Sequoia, Netherlands.

Baker, A Review of Pyrolysis Studies to Unravel Reaction Steps in Burning Tobacco,Jjournal of Analytical and Applied Pyrolysis, 1987, pp. 555–573, vol. 11, Elsevier Science Publishers B.V., Amsterdam, Netherlands.

Schimanke et al., In Situ XRD Study of the Phase Transition of Nanocrystalline Maghemite (γ–$Fe_2O_3$) to Hematite (α–$Fe_2O_3$), Solid State Ionics, 2000, pp. 1235–1240, Vols 136–137, Elsevier Science B.V., Amsterdam, Holland.

Miser et al., Evidence of the Mechanisms of Catalysis and Deactivation of a Nanoparticle Iron Oxide, submitted to Applied Catalysis A, Apr. 2003.

Rostami et al., Formation and Reduction of Carbon Monoxide in a Burning Cigarette, Accepted for Publication by Beitrage zur Takakforschung, Apr. 2003.

Li et al., The Catalytic/oxidative Effect of Iron Oxide Nanoparticles on Carbon Monoxide and the Pyrolytic Products of Biomass Model Compounds, Nanotechnology in Catalysis, Kluwer Academic/Plenum, Dordrecht, Nerderlands Baker R., The Effect of Ventilation on Cigarette Combustion Mechanism, Recent Advances in Tobacco Science, 1984, pp. 88–150, vol. 10.

Baker, R., Mechanisms of Smoke Formation and Delivery, Recent Advances in Tobacco Science, 1980, pp. 184–224, vol. 6.

Shin et al., Heterogeneous Cracking of Catechol Under Partially Oxidative Conditions, Submitted to Fuel.

Shin et al., Characterizing Biomatrix Materials Using Pyrolysis Molecular Beam Mass Spectrometer and Pattern Recognition, Submitted to Journal of Analytical & Applied Pyrolysis, Elsevier.

Bone et al., Studies Upon Catalytic Combustion—Part I. The Union of Carbon Monoxide and Oxygen in Contact with a Gold Surface, Proc. Royal Society (London) 1925, pp. 459–476, vol. 109, England.

Li et al., Application of Nanoparticle Iron Oxide in Cigarette for Simultaneous CO and NO Removal in the Mainstream Smoke, Submitted to Beitrage for Review and Publication, Feb. 2003.

Robie et al., Thermodynamic Properties of Minerals and Related Substances at 298.15 K and 1 Bar ($10^5$pascals) Pressure and at Higher Temperatures, U.S. Geological Survey Bulletin 1452, 1984.

Eichler et al., Reaction Channels for the Catalytic Oxidation of CO on Pt(111), Physical Review B, 1999–11, pp. 5960–5967, vol. 59, No. 8, The American Physical Society.

Lai et al., Thermal Reactions of m–cresol over Calcium Oxide Between 350 and 600° C., Fuel, 1987, pp. 525–531, vol. 66, Butterworth & Co. (Publishers), Ltd., England.

Haruta et al., Synergism in the Catalysis of Supported Gold, *New Aspects of Spillover Effect in Catalysis,* vol. 77, 1993, pp. 45–52, Elsevier Science Publishers.

Ed. Lide, CRC *Handbook of Chemistry & Physics, A Ready–Reference Book of Chemical & Physical Date,* 2000–2001, p. 6–2, 81$^{st}$ Edition, CRC Press, USA.

Im et al., Formation of Nitric Oxide During Tobacco Oxidation, Submitted to the Journal of Agricultural & Food Chemistry in May 2003.

Li et al., The Removal of Carbon Monoxide by Iron Oxide Nanoparticles, Applied Catalysis B: Environmental, 2003, pp. 151–162, vol. 43, Elsevier Science Pub. Co., Amsterdam, Netherlands.

Hopkinson et al., Surface Restructuring Dynamics in CO Adsorption, Desorption and Reaction with No on Pt(100). Chemical Physics, 1993, pp. 433–452, vol. 177, North Holland Publishing, Amsterdam, Netherlands.

Schlögl et al., Oxidation of Carbon Monoxide over Palladium on Zirconia Prepared from Amorphous Pd–Zr Alloy, II the Nature of the Active Surface, Journal of Catalysis, 1992, pp. 139–157, vol. 137, Academic Press, Inc., USA.

Bond et al., Catalysis by Gold, Catalysis. *Catal. Rev.–Sci. Eng.,* 1999, pp. 319–388, vol. 41 (3&4), Marcal Dekker, Inc. New York, New York USA.

Miser et al., High–Resolution TEM Characterization of Iron Oxide Catalyst and Reaction Products, ACS Symposium, Call 19.

Evans et al., Chemistry of Tar Formation and Maturation in the Thermochemical Conversion of Biomass, *Fuel* & *Energy Abstracts,* May 1998, p. 197, Alternative Energy Sources.

Notification of Transmittal of the International Search Report or the Declaration for PCT/US03/03456 dated Jun. 4, 2003.

* cited by examiner

SCHEMATICS OF QUARTZ FLOW TUBE REACTOR

USE OF OXYHYDROXIDE COMPOUNDS FOR REDUCING CARBON MONOXIDE IN THE MAINSTREAM SMOKE OF A CIGARETTE

FIELD OF INVENTION

The invention relates generally to methods for reducing the amount of carbon monoxide in the mainstream smoke of a cigarette during smoking. More specifically, the invention relates to cut filler compositions, cigarettes, methods for making cigarettes and methods for smoking cigarettes that involve the use of oxyhydroxide compounds, which decompose during smoking to produce one or more products capable of acting as an oxidant for the conversion of carbon monoxide to carbon dioxide and/or as a catalyst for the conversion of carbon monoxide to carbon dioxide.

BACKGROUND

Various methods for reducing the amount of carbon monoxide in the mainstream smoke of a cigarette during smoking have been proposed. For example, British Patent No. 863,287 describes methods for treating tobacco prior to the manufacture of tobacco articles, such that incomplete combustion products are removed or modified during smoking of the tobacco article. In addition, cigarettes comprising absorbents, generally in a filter tip, have been suggested for physically absorbing some of the carbon monoxide. Cigarette filters and filtering materials are described, for example, in U.S. Reissue Pat. No. RE 31,700; U.S. Pat. No. 4,193,412; British Patent No. 973,854; British Patent No. 685,822; British Patent No. 1,104,993 and Swiss patent 609,217. However, such methods are usually not completely efficient.

Catalysts for the conversion of carbon monoxide to carbon dioxide are described, for example, in U.S. Pat. Nos. 4,317,460, 4,956,330; 5,258,330; 4,956,330; 5,050,621; and 5,258,340, as well as in British Patent No. 1,315,374. The disadvantages of incorporating a conventional catalyst into a cigarette include the large quantities of oxidant that need to be incorporated into the filter to achieve considerable reduction of carbon monoxide. Moreover, if the ineffectiveness of the heterogeneous reaction is taken into account, the amount of the oxidant required would be even larger.

Metal oxides, such as iron oxide have also been incorporated into cigarettes for various purposes. See, for example, International Publications WO 87/06104 and WO 00/40104, as well as U.S. Pat. Nos. 3,807,416 and 3,720,214. Iron oxide has also been proposed for incorporation into tobacco articles, for a variety of other purposes. For example, iron oxide has been described as particulate inorganic filler (e.g. U.S. Pat. Nos. 4,197,861; 4,195,645; and 3,931,824), as a coloring agent (e.g. U.S. Pat. No. 4,119,104) and in powder form as a burn regulator (e.g. U.S. Pat. No. 4,109,663). In addition, several patents describe treating filler materials with powdered iron oxide to improve taste, color and/or appearance (e.g. U.S. Pat. Nos. 6,095,152; 5,598,868; 5,129,408; 5,105,836 and 5,101,839). However, the prior attempts to make cigarettes incorporating metal oxides, such as FeO or $Fe_2O_3$ have not led to the effective reduction of carbon monoxide in mainstream smoke.

Despite the developments to date, there remains a need for improved and more efficient methods and compositions for reducing the amount of carbon monoxide in the mainstream smoke of a cigarette during smoking. Preferably, such methods and compositions should not involve expensive or time consuming manufacturing and/or processing steps. More preferably, it should be possible to catalyze or oxidize carbon monoxide not only in the filter region of the cigarette, but also along the entire length of the cigarette during smoking.

SUMMARY

The invention provides cut filler compositions, cigarettes, methods for making cigarettes and methods for smoking cigarettes that involve the use of an oxyhydroxide compound, which is capable of decomposing to form at least one product capable of acting as an oxidant for the conversion of carbon monoxide to carbon dioxide and/or as a catalyst for the conversion of carbon monoxide to carbon dioxide.

One embodiment of the invention relates to a cut filler composition comprising tobacco and an oxyhydroxide compound, wherein during combustion of the cut filler composition, the oxyhydroxide compound is capable of decomposing to form at least one product capable of acting as an oxidant for the conversion of carbon monoxide to carbon dioxide and/or as a catalyst for the conversion of carbon monoxide to carbon dioxide.

Another embodiment of the invention relates to a cigarette comprising a tobacco rod, wherein the tobacco rod comprises a cut filler composition comprising tobacco and an oxyhydroxide compound. During smoking of the cigarette, the oxyhydroxide compound is capable of decomposing to form at least one product capable of acting as an oxidant for the conversion of carbon monoxide to carbon dioxide and/or as a catalyst for the conversion of carbon monoxide to carbon dioxide. The cigarette preferably comprises from about 5 mg to about 200 mg of the oxyhydroxide compound per cigarette, and more preferably from about 40 mg to about 100 mg of the oxyhydroxide compound per cigarette.

A further embodiment of the invention relates to a method of making a cigarette, comprising (i) adding an oxyhydroxide compound to a cut filler, wherein the oxyhydroxide compound is capable of decomposing during the smoking of the cigarette to form at least one product capable of acting as an oxidant for the conversion of carbon monoxide to carbon dioxide and/or as a catalyst for the conversion of carbon monoxide to carbon dioxide; (ii) providing the cut filler comprising the oxyhydroxide compound to a cigarette making machine to form a tobacco rod; and (iii) placing a paper wrapper around the tobacco rod to form the cigarette. The cigarette thus produced preferably comprises from about 5 mg to about 200 mg of the oxyhydroxide compound per cigarette, and more preferably from about 40 mg to about 100 mg of the oxyhydroxide compound per cigarette.

Yet another embodiment of the invention relates to a method of smoking the cigarette described above, which involves lighting the cigarette to form smoke and inhaling the smoke, wherein during the smoking of the cigarette, the oxyhydroxide compound is capable of decomposing to form at least one product capable of acting as an oxidant for the conversion of carbon monoxide to carbon dioxide and/or as a catalyst for the conversion of carbon monoxide to carbon dioxide.

In a preferred embodiment of the invention, the oxyhydroxide compound is capable of decomposing to form at least one product capable of acting as both an oxidant for the conversion of carbon monoxide to carbon dioxide and as a catalyst for the conversion of carbon monoxide to carbon dioxide. Preferred oxyhydroxide compounds include, but are not limited to: FeOOH, AlOOH, TiOOH, and mixtures thereof, with FeOOH being particularly preferred. Preferably, the oxyhydroxide compound is capable of decomposing to form at least one product selected from the group consisting of $Fe_2O_3$, $Al_2O_3$, $TiO_2$, and mixtures thereof. Preferably, the product formed from the decomposition of the oxyhydroxide during combustion of the cut filler composition is present in an amount effective to convert at least 50% of the carbon monoxide to carbon dioxide.

In yet another preferred embodiment, the oxyhydroxide compound and/or the product formed from the decomposition of the oxyhydroxide during combustion of the cut filler composition is in the form of nanoparticles, preferably having an average particle size less than about 500 nm, more preferably having an average particle size less than about 100 nm, more preferably having an average particle size less than about 50 nm, and most preferably having an average particle size less than about 5 nm.

BRIEF DESCRIPTION OF THE DRAWINGS

Various features and advantages of this invention will be apparent upon consideration of the following detailed description, taken in conjunction with the accompanying drawings, in which.

DETAILED DESCRIPTION

Figure 1:
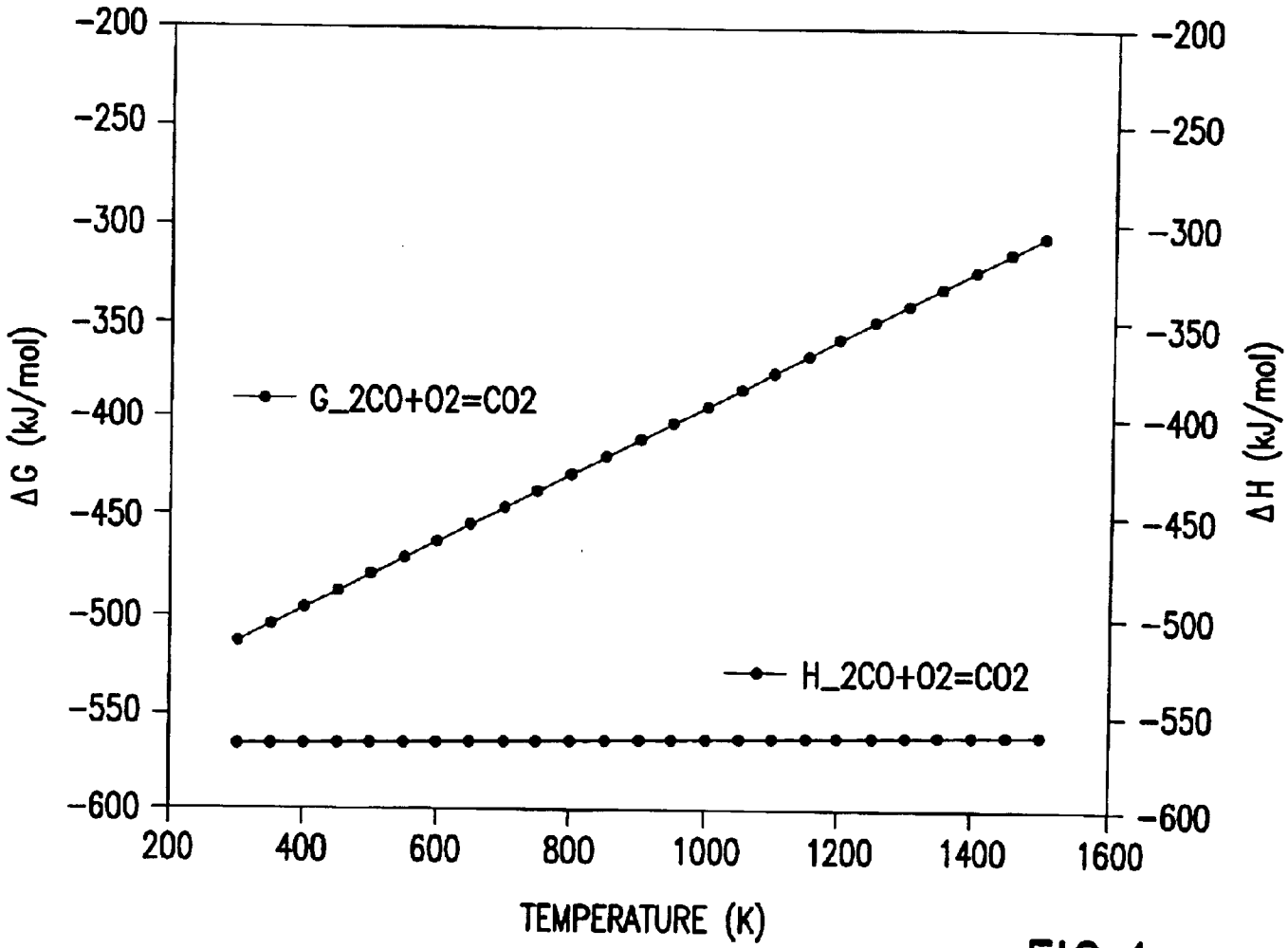
FIG. 1 depicts the temperature dependence of the Gibbs Free Energy and Enthalpy for the oxidation reaction of carbon monoxide to form carbon dioxide.

The invention provides cut filler compositions, cigarettes, methods for making cigarettes and methods for smoking cigarettes which involve the use of an oxyhydroxide compound that is capable of decomposing during smoking to form at least one product capable of acting as an oxidant for the conversion of carbon monoxide to carbon dioxide and/or as a catalyst for the conversion of carbon monoxide to carbon dioxide. Through the invention, the amount of carbon monoxide in mainstream smoke can be reduced, thereby also reducing the amount of carbon monoxide reaching the smoker and/or given off as second-hand smoke.

The term "mainstream" smoke refers to the mixture of gases passing down the tobacco rod and issuing through the filter end, i.e. the amount of smoke issuing or drawn from the mouth end of a cigarette during smoking of the cigarette. The mainstream smoke contains smoke that is drawn in through both the lit region of the cigarette, as well as through the cigarette paper wrapper.

The total amount of carbon monoxide present in mainstream smoke and formed during smoking comes from a combination of three main sources: thermal decomposition (about 30%), combustion (about 36%) and reduction of carbon dioxide with carbonized tobacco (at least 23%). Formation of carbon monoxide from thermal decomposition starts at a temperature of about 180° C., and finishes at around 1050° C., and is largely controlled by chemical kinetics. Formation of carbon monoxide and carbon dioxide during combustion is controlled largely by the diffusion of oxygen to the surface ($k_a$) and the surface reaction ($k_b$). At 250° C., ka and kb, are about the same. At 400° C., the reaction becomes diffusion controlled. Finally, the reduction of carbon dioxide with carbonized tobacco or charcoal occurs at temperatures around 390° C. and above. Besides the tobacco constituents, the temperature and the oxygen concentration are the two most significant factors affecting the formation and reaction of carbon monoxide and carbon dioxide.

While not wishing to be bound by theory, it is believed that the oxyhydroxide compounds decompose under conditions for the combustion of the cut filler or the smoking of the cigarette to produce either catalyst or oxidant compounds, which target the various reactions that occur in different regions of the cigarette during smoking. During smoking there are three distinct regions in a cigarette: the combustion zone, the pyrolysis/distillation zone, and the condensation/filtration zone. First, the "combustion region" is the burning zone of the cigarette, produced during smoking of the cigarette, usually at the lit end of a cigarette. The temperature in the combustion zone ranges from about 700° C. to about 950° C., and the heating rate can go as high as 500° C./second. The concentration of oxygen is low in this region, since it is being consumed in the combustion of tobacco to produce carbon monoxide, carbon dioxide, water vapor, and various organics. This reaction is highly exothermic and the heat generated here is carried by gas to the pyrolysis/distillation zone. The low oxygen concentrations coupled with the high temperature in the combustion region leads to the reduction of carbon dioxide to carbon monoxide by the carbonized tobacco. In the combustion region, it is desirable to use an oxyhydroxide that decomposes to form an oxidant in situ, which will convert carbon monoxide to carbon dioxide in the absence of oxygen. The oxidation reaction begins at around 150° C., and reaches maximum activity at temperatures higher than about 460° C.

Next, the "pyrolysis region" is the region behind the combustion region, where the temperatures range from about 200° C. to about 600° C. This is where most of the carbon monoxide is produced. The major reaction in this region is the pyrolysis (i.e. the thermal degradation) of the tobacco that produces carbon monoxide, carbon dioxide, smoke components, and charcoal using the heat generated in the combustion zone. There is some oxygen present in this zone, and thus it is desirable to use an oxyhydroxide that decomposes to produce a catalyst in situ for the oxidation of carbon monoxide to carbon dioxide. The catalytic reaction begins at 150° C. and reaches maximum activity around 300° C. In a preferred embodiment, the catalyst may also retain oxidant capability after it has been used as a catalyst, so that it can also function as an oxidant in the combustion region as well.

Finally, there is the condensation/filtration zone, where the temperature ranges from ambient to about 150° C. The major process is the condensation/filtration of the smoke components. Some amount of carbon monoxide and carbon dioxide diffuse out of the cigarette and some oxygen diffuses into the cigarette. However, in general, the oxygen level does not recover to the atmospheric level.

In commonly-assigned U.S. application Ser. No. 09/942,881, filed Aug. 31, 2001, and entitled "Oxidant/Catalyst Nanoparticles to Reduce Carbon Monoxide in the Mainstream Smoke of a Cigarette", various oxidant/catalyst nanoparticles are described for reducing the amount of carbon monoxide in mainstream smoke. The disclosure of this application is hereby incorporated by reference in its entirety. While the use of these catalysts reduce the amount of carbon monoxide in mainstream smoke during smoking, it is further desirable to minimize or prevent contamination and/or deactivation of catalysts used in the cigarette filler, particularly over long periods of storage. One potential way of achieving this result is to use an oxyhydroxide compound to generate the catalyst or oxidant in situ during smoking of the cigarette. For instance, FeOOH decomposes to form $Fe_2O_3$ and water at temperatures typically reached during smoking of the cigarette, e.g. above about 200° C.

By "oxyhydroxide" is meant a compound containing a hydroperoxo moiety, i.e. "—O—O—H". Examples of oxyhydroxides include, but are not limited to: FeOOH, AlOOH, and TiOOH. Any suitable oxyhydroxide compound may be used, which is capable of decomposing, under the temperature conditions achieved during smoking of a cigarette, to produce compounds which function as an oxidant and/or as a catalyst for converting carbon monoxide to carbon dioxide. In a preferred embodiment of the invention, the oxyhydroxide forms a product that is capable of acting as both an oxidant for the conversion of carbon monoxide to carbon dioxide and as a catalyst for the conversion of carbon monoxide to carbon dioxide. It is also possible to use combinations of oxyhydroxide compounds to obtain this effect.

Preferably, the selection of an appropriate oxyhydroxide compound will take into account such factors as stability and preservation of activity during storage conditions, low cost and abundance of supply. Preferably, the oxyhydroxide will be a benign material. Further, it is preferred that the oxyhydroxide compound does not react or form unwanted byproducts during smoking.

Preferred oxyhydroxide compounds are stable when present in cut filler compositions or in cigarettes, at typical room temperature and pressure, as well as under prolonged storage conditions. Preferred oxyhydroxide compounds include inorganic oxyhydroxide compounds that decompose during smoking of a cigarette, to form metal oxides. For example, in the following reaction, M represents a metal:

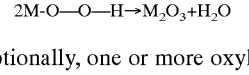

$$2M\text{-}O—O—H \rightarrow M_2O_3 + H_2O$$

Optionally, one or more oxyhydroxides may also be used as mixtures or in combination, where the oxyhydroxides may be different chemical entities or different forms of the same metal oxyhydroxides. Preferred oxyhydroxide compounds include, but are not limited to: FeOOH, AlOOH, TiOOH, and mixtures thereof, with FeOOH being particularly preferred. Other preferred oxyhydroxide compounds include those that are capable of decomposing to form at least one product selected from the group consisting of $Fe_2O_3$, $Al_2O_3$, $TiO_2$, and mixtures thereof. Particularly preferred oxyhydroxides include FeOOH, particularly in the form of α-FeOOH (goethite); however, other forms of FeOOH such as γ-FeOOH (lepidocrocite), β-FeOOH (akaganeite), and δ'-FeOOH (feroxyhite) may also be used. Other preferred oxyhydroxides include γ-AlOOH (boehmite) and α-AlOOH (diaspore). The oxyhydroxide compound may be made using any suitable technique, or purchased from a commercial supplier, such as Aldrich Chemical Company, Milwaukee, Wis.

FeOOH is preferred because it produces $Fe_2O_3$ upon thermal degradation. $Fe_2O_3$ is a preferred catalyst/oxidant because it is not known to produce any unwanted byproducts, and will simply be reduced to FeO or Fe after the reaction. Further, when $Fe_2O_3$ is used as the oxidant/catalyst, it will not be converted to an environmentally hazardous material. In addition, use of a precious metal can be avoided, as both $Fe_2O_3$ and $Fe_2O_3$ nanoparticles are economical and readily available. Moreover, $Fe_2O_3$ is capable of acting as both an oxidant for the conversion of carbon monoxide to carbon dioxide and as a catalyst for the conversion of carbon monoxide to carbon dioxide.

Figure 2:
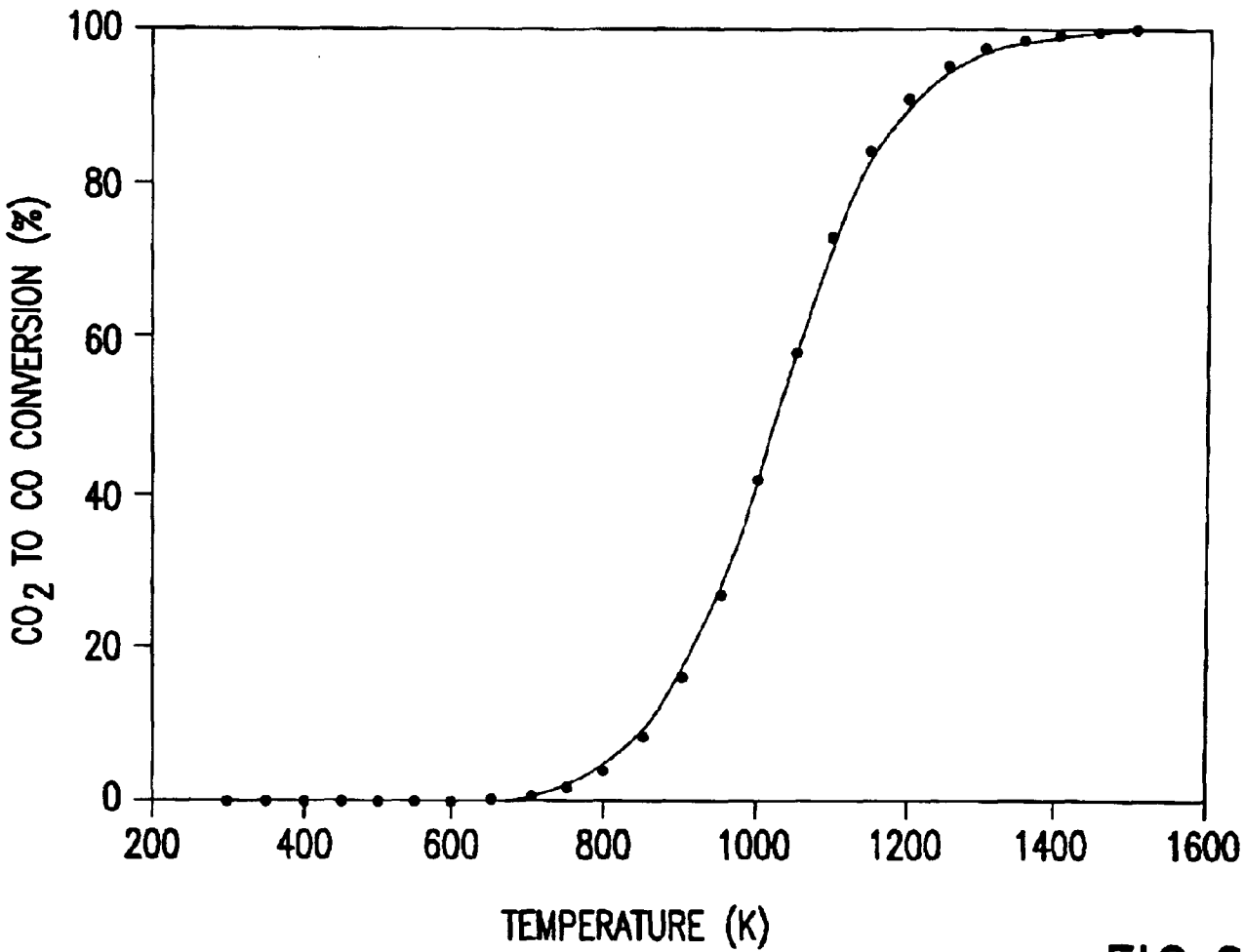
FIG. 2 depicts the temperature dependence for the conversion of carbon dioxide to carbon monoxide by carbon.

In selecting an oxyhydroxide compound, various thermodynamic considerations may be taken into account, to ensure that oxidation and/or catalysis will occur efficiently, as will be apparent to the skilled artisan. For reference, FIG. 1 shows a thermodynamic analysis of the Gibbs Free Energy and Enthalpy temperature dependence for the oxidation of carbon monoxide to carbon dioxide. FIG. 2 shows the temperature dependence of the percentage of carbon dioxide conversion with carbon to form carbon monoxide.

The following thermodynamic equations are useful for analyzing the limits of the relevant reactions and their dependence on temperature:

At p=1 atm, $$C_p=a+b\cdot y+c\cdot y^{-2}+d\cdot y^2 \quad \text{in J/(mol·K)}$$

$$H=10^3[H^{\ddagger}+a\cdot y+(b/2)\cdot y^2-c\cdot y^{-1}+(d/3)\cdot y^3] \quad \text{in J/mol}$$

$$S=S^{\ddagger}+a\cdot \ln(T/K)+b\cdot y-(c/2)\cdot y^{-2}+(d/2)\cdot y^2 \quad \text{in J/(mol·K)}$$

$$G=10^3[H^{\ddagger}-S^{\ddagger}\cdot y-a\cdot y\cdot \ln(T-1)-(b/2)\cdot y^2-(c/2)\cdot y^2-(d/6)\cdot y^3] \quad \text{in J/mol}$$

where $y=10^3+T$

The equilibrium constant Ke can be calculated from ΔG: $K_e=\exp[-\Delta G/(R\cdot T)]$. For some reactions, or the percentages of the conversions, α, can be calculated from $K_e$.

TABLE 1

Thermodynamic parameters and constants.

| | A | B | C | d | H‡ | S‡ |
|---|---|---|---|---|---|---|
| C (graphite) | 0.109 | 38.940 | −0.146 | −17.385 | −2.101 | −6.546 |
| CO (gas) | 30.962 | 2.439 | −0.280 | | −120.809 | 18.937 |
| $CO_2$ (gas) | 51.128 | 4.368 | −1.469 | | −413.886 | −87.937 |
| $O_2$ (gas) | 29.154 | 6.477 | −0.184 | −1.017 | −9.589 | 36.116 |
| FeG (solid) | 48.794 | 8.372 | −0.289 | | −281.844 | −222.719 |
| $Fe_3O_4$ (solid) | 91.558 | 201.970 | | | −1151.755 | −435.650 |
| $Fe_2O_3$ (solid) | 98.278 | 77.818 | −1.485 | | −861.153 | −504.059 |
| FeOOH (solid) | 49.371 | 83.680 | | | −576.585 | −245.871 |
| $H_2O$ (vapor) | 34.376 | 7.841 | −0.423 | | −253.871 | −11.75 |
| $H_2$ (gas) | 26.882 | 3.568 | 0.105 | | −7.823 | −22.966 |

Figure 3:
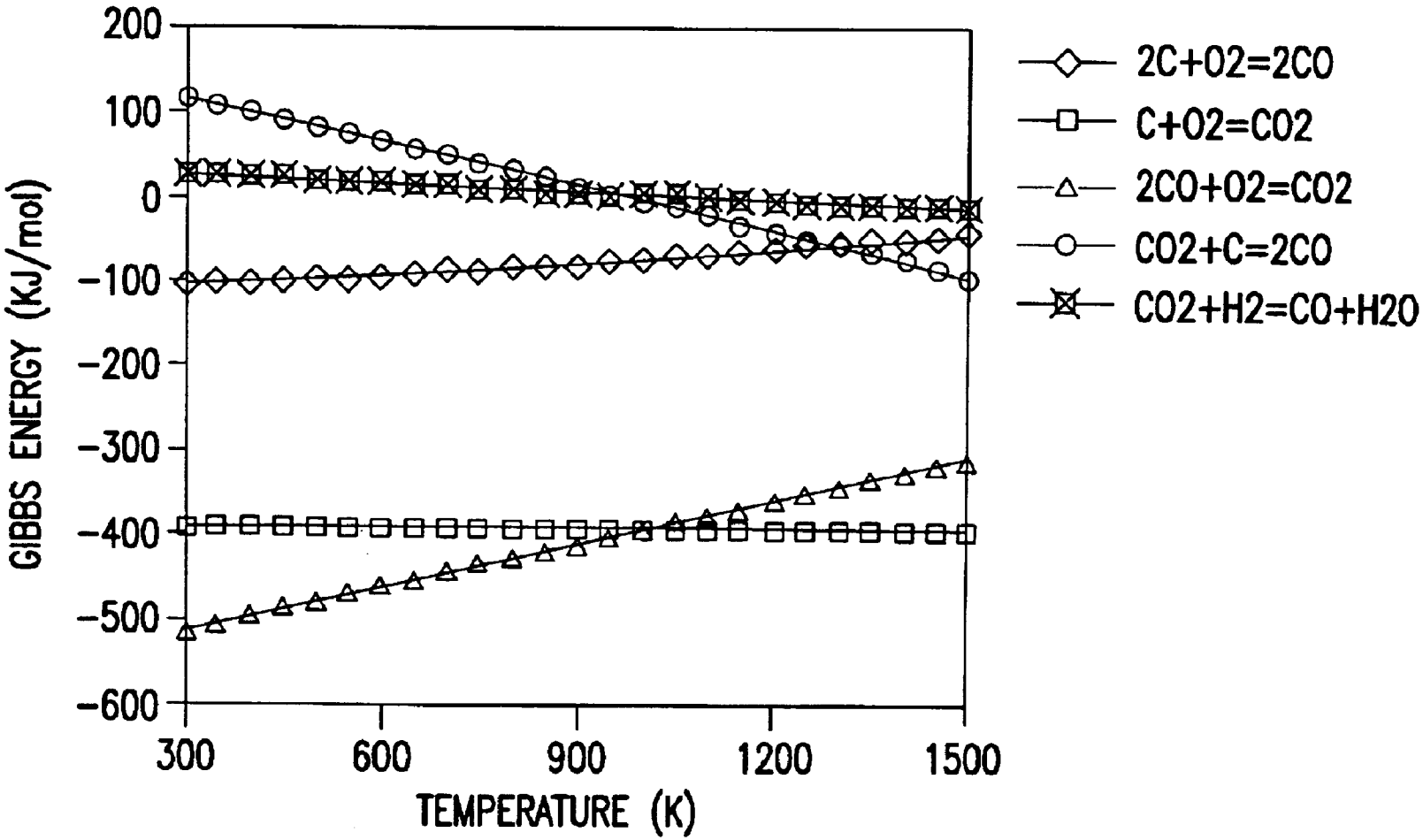
FIG. 3 depicts a comparison of the Gibbs Energy changes of various reactions among carbon, oxygen, carbon monoxide, carbon dioxide, and hydrogen gas.

FIG. 3 shows a comparison of the Gibbs free energy changes of various reactions involving carbon, carbon monoxide, carbon dioxide, and oxygen. As shown in the chart, both the oxidation reaction of carbon to carbon monoxide, and the oxidation of carbon monoxide to carbon dioxide are thermodynamically favorable. The oxidation of carbon to carbon dioxide is more favorable, according the ΔG of the reaction. The oxidation of carbon monoxide to carbon dioxide is also strongly favorable. Therefore, in the combustion zone, carbon dioxide should be the dominating product unless there is a shortage of oxygen. As shown in FIG. 3, under oxygen deficient conditions, carbon dioxide can be reduced to carbon monoxide by carbon. There is also the possibility that the carbon dioxide may be reduced to carbon monoxide by hydrogen, since hydrogen is also generated in the combustion process.

Figure 4:
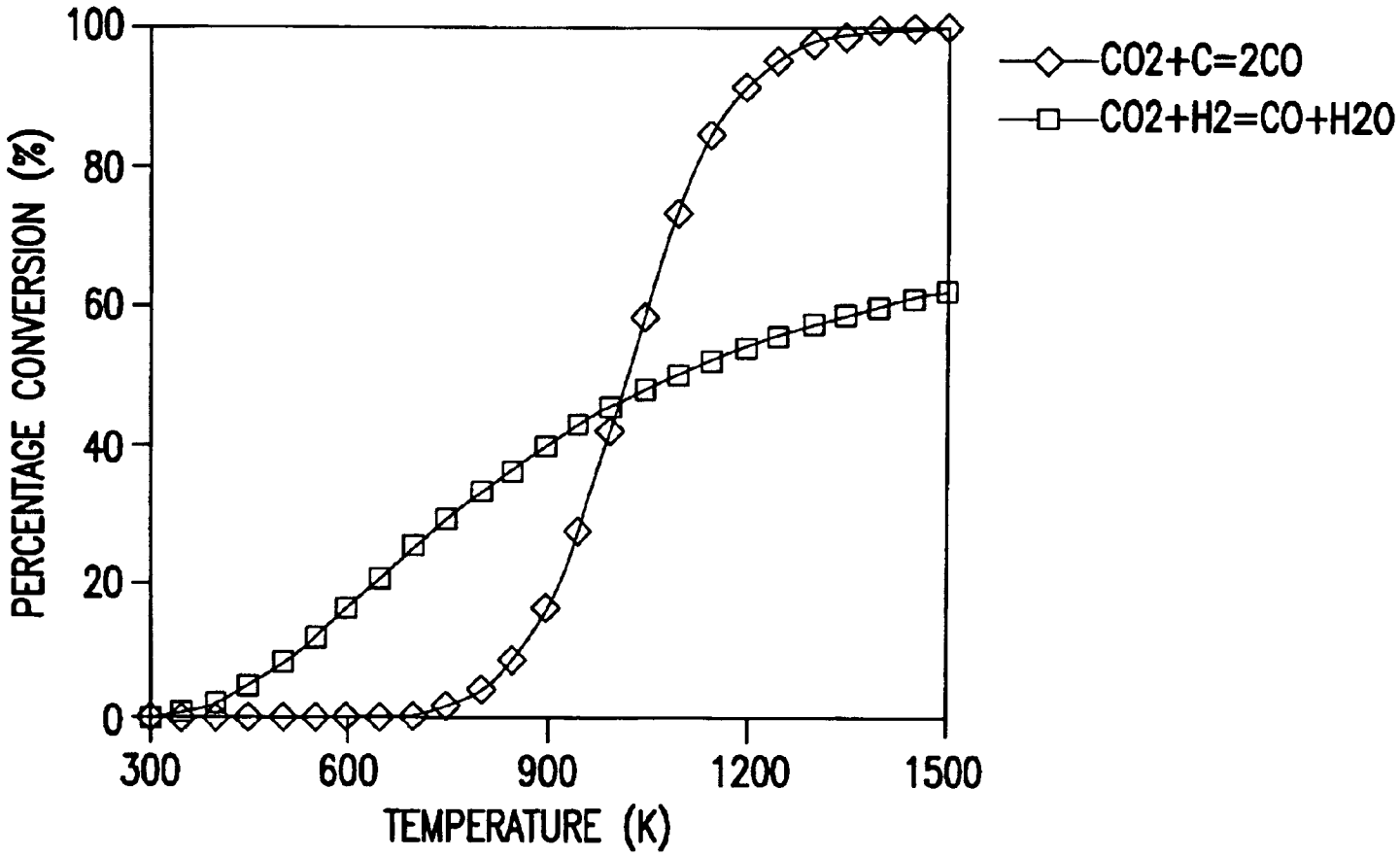
FIG. 4 depicts the percentage conversion of carbon dioxide to carbon monoxide at different temperatures, by carbon and hydrogen respectively.

FIG. 4 shows the percentage of carbon dioxide converted to carbon monoxide, by carbon and hydrogen respectively, under oxygen deficient conditions at different temperatures. The reduction of carbon dioxide by carbon starts at about 700 K, which is very close to the experimental observation of about 400° C. At the combustion zone, where the temperature is about 800° C., as shown in FIG. 4, about 80% of carbon dioxide will be reduced to carbon monoxide. While the carbon dioxide may be reduced by hydrogen gas, this reaction is unlikely as hydrogen gas diffuses out of the cigarette quickly.

Figure 5:
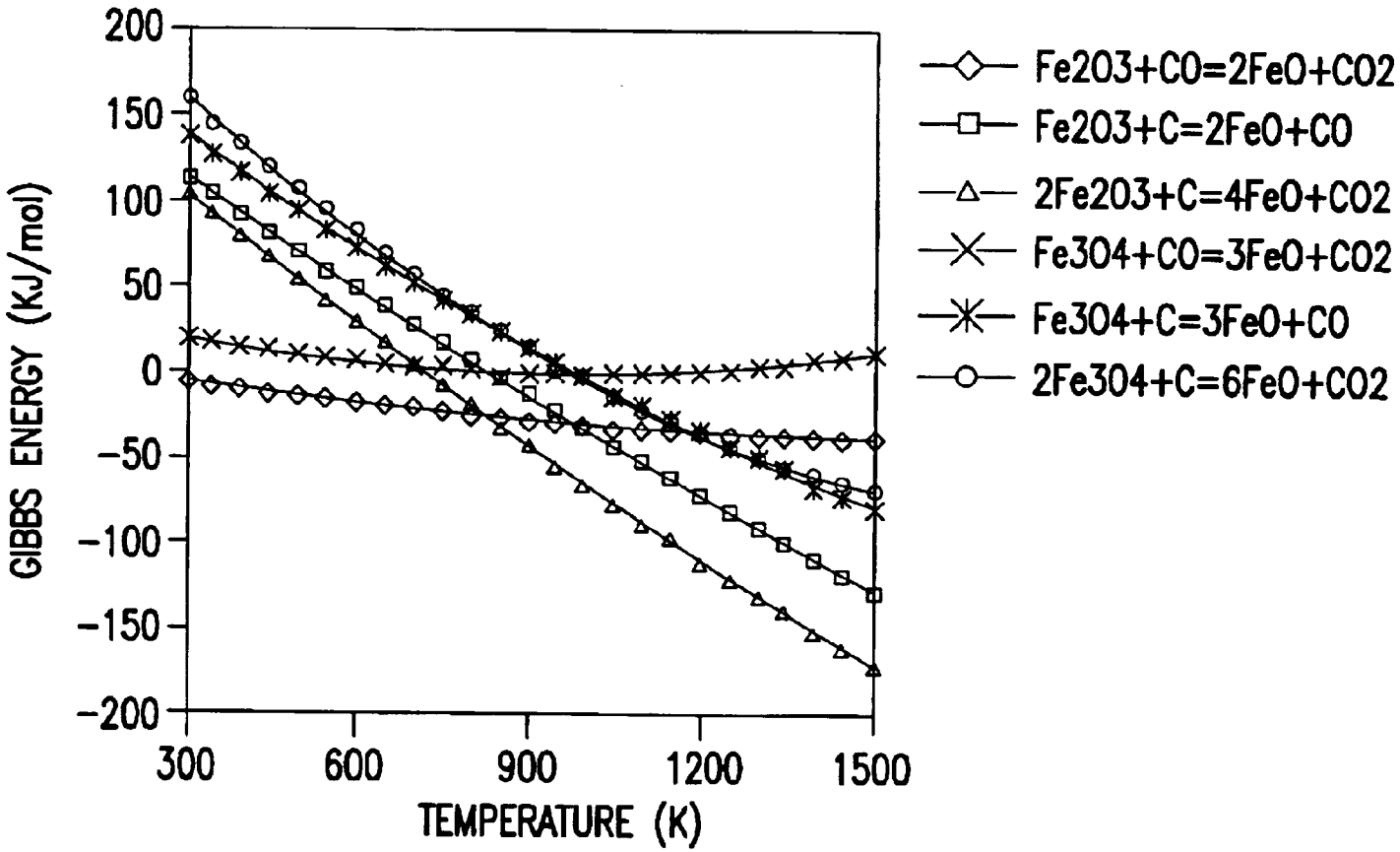
FIG. 5 depicts the Gibbs Energy changes for several reactions involving Fe(III) and/or carbon monoxide.

FIGS. 5–8 illustrate the effect of using iron compounds as oxidant and/or catalyst in cigarettes for the oxidation of carbon monoxide to carbon dioxide. As shown in FIG. 5, the oxidation of carbon monoxide to carbon dioxide is energetically favorable for $Fe_2O_3$, even at room temperature. At higher temperature, the oxidation of carbon by $Fe_2O_3$ also becomes energetically favorable. Similar trends are observed for the reactions of $Fe_3O_4$ with carbon and carbon monoxide, but generally the reactions with $Fe_3O_4$ are less energetically favorable than with $Fe_2O_3$. The competition with carbon with carbon monoxide should not be significant since the reaction with carbon is solid to solid reaction that usually cannot proceed unless the temperature is very high.

Figure 6:
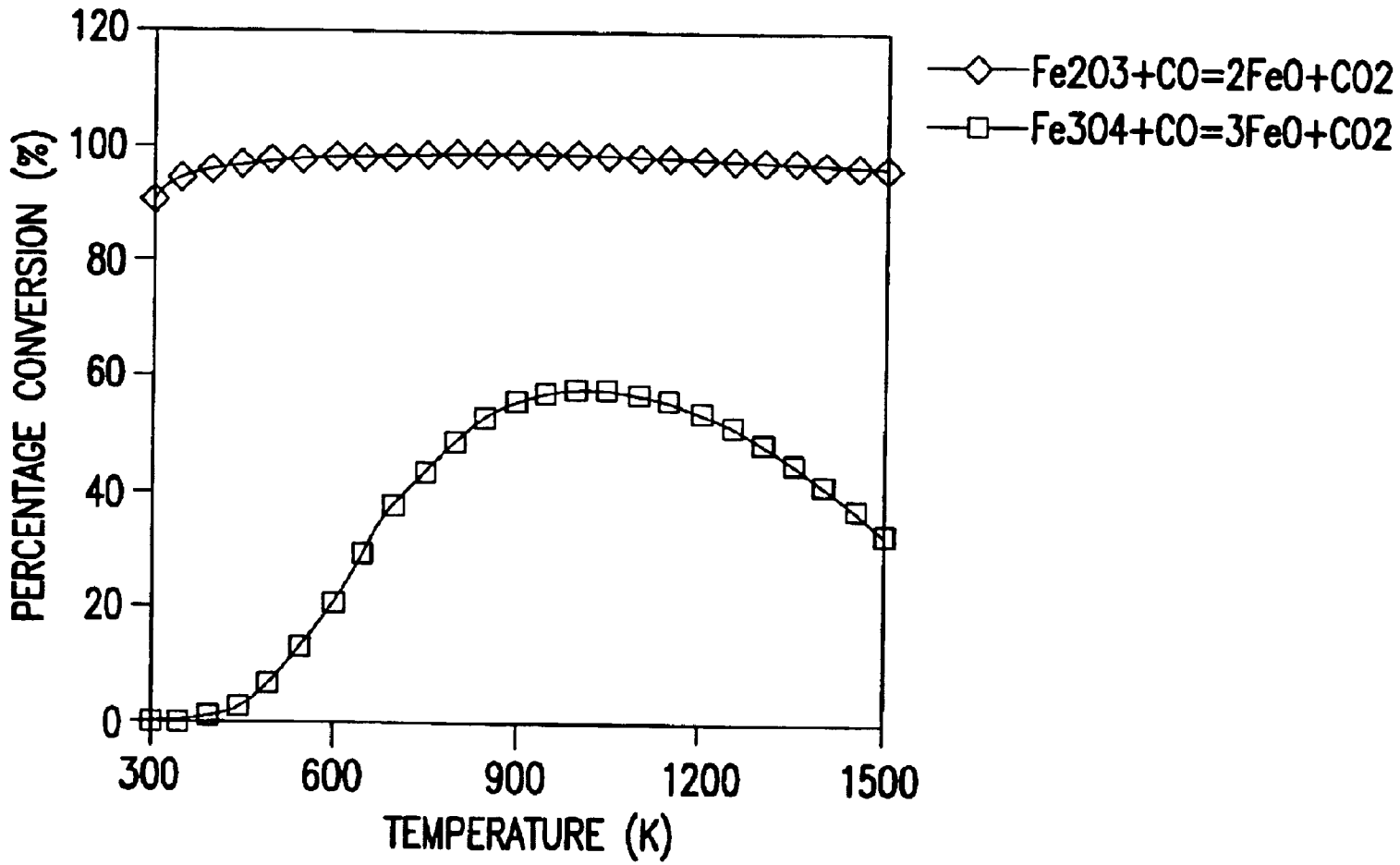
FIG. 6 depicts the conversion of carbon monoxide to carbon dioxide by $Fe_2O_3$ and $Fe_3O_4$ respectively, over a range of temperatures.
Figure 7:
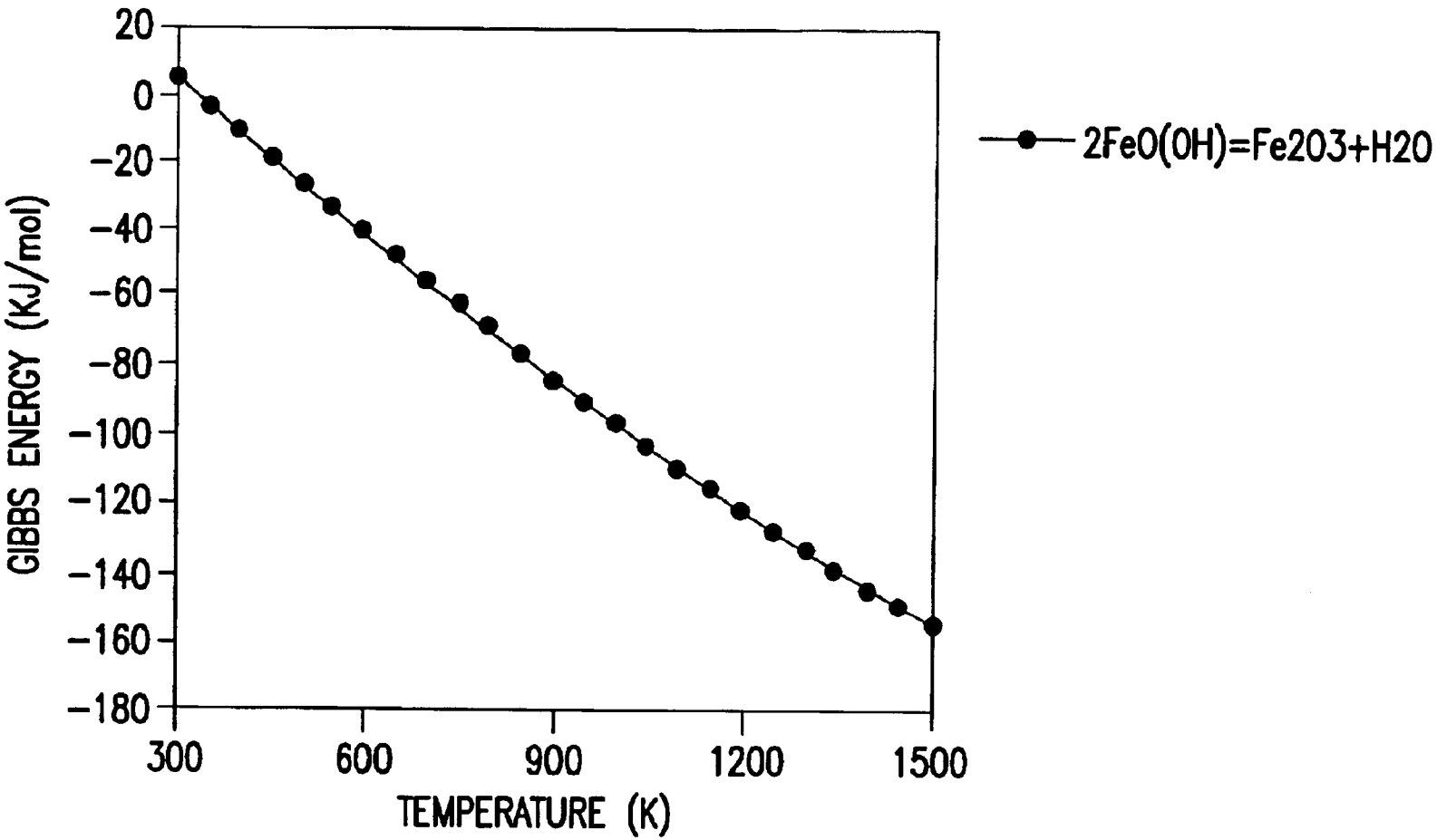
FIG. 7 depicts the Gibbs Energy change for the decomposition of FeOOH, over a range of temperatures.

FIG. 6 shows the temperature dependence for the conversion of carbon monoxide to carbon dioxide. With $Fe_2O_3$, the carbon monoxide to carbon dioxide conversion percentage can reach almost 100% in a broad temperature range staring with the ambient temperature. $Fe_3O_4$ is less effective. It is desirable to use freshly prepared $Fe_2O_3$ to maintain the high activity. One possible way to do this is generating the $Fe_2O_3$ in situ from an iron oxyhydroxide, such as FeOOH. While FeOOH is stable at ambient temperature, it will thermally decompose to form $Fe_2O_3$ and water, at temperatures around 200° C. Thermodynamic calculations confirm that decomposition is an energetically favorable process, as shown in FIG. 7.

Figure 8:
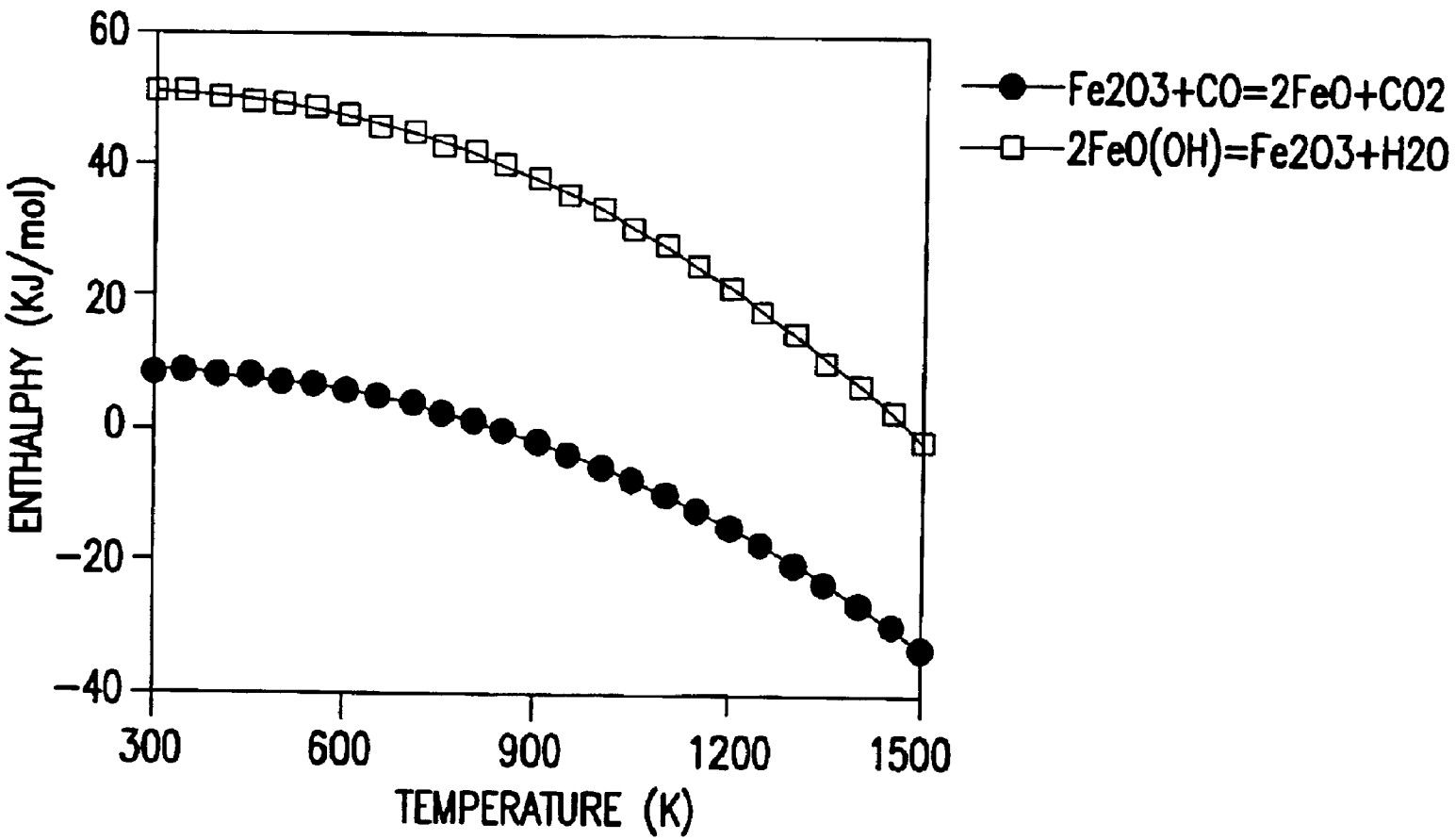
FIG. 8 depicts the Enthalpy Changes of FeOOH decomposition and $Fe_2O_3$ reduction, respectively, over a range of temperatures.

Another advantage of using FeOOH instead of $Fe_2O_3$ as the oxidant is that the decomposition of FeOOH is endothermic over a broad temperature range, as shown in FIG. 8. Thus, the heat consumed in the decomposition is more than the heat generated by the reduction of $Fe_2O_3$ by carbon monoxide. The net result is a slight decrease of the temperature in the combustion zone, which also contributes to the reduction of carbon monoxide concentration in mainstream smoke.

During combustion, NO is also produced in mainstream smoke at a concentration of about 0.45 mg/cigarette. However, NO can be reduced by carbon monoxide according to the following reactions:

$$2NO+CO\rightarrow N_2O+CO_2$$

$$N_2O+CO\rightarrow N_2+CO_2$$

Iron oxide, either in the reduced form of $Fe_3O_4$ or in the oxidized form of $Fe_2O_3$, acts as a good catalyst for these two reactions at temperatures around about 300° C. Therefore, the addition of iron oxide or its generation in situ in the cigarette during smoking could potentially minimize the concentration of NO in mainstream smoke as well.

In a preferred embodiment of the invention, the oxyhydroxide compound and/or the product formed from the decomposition of the oxyhydroxide during combustion or smoking is in the form of nanoparticles. By "nanoparticles" is meant that the particles have an average particle size of less than a micron. The preferred average particle size is less than about 500 nm, more preferably less than about 100 nm, even more preferably less than about 50 nm, and most preferably less than about 5 nm. Preferably, the oxyhydroxide compound and/or the product formed from the decomposition of the oxyhydroxide during combustion or smoking has a surface area from about 20 $m^2/g$ to about 400 $m^2/g$, or more preferably from about 200 $m^2/g$ to about 300 $m^2/g$.

Figure 9:
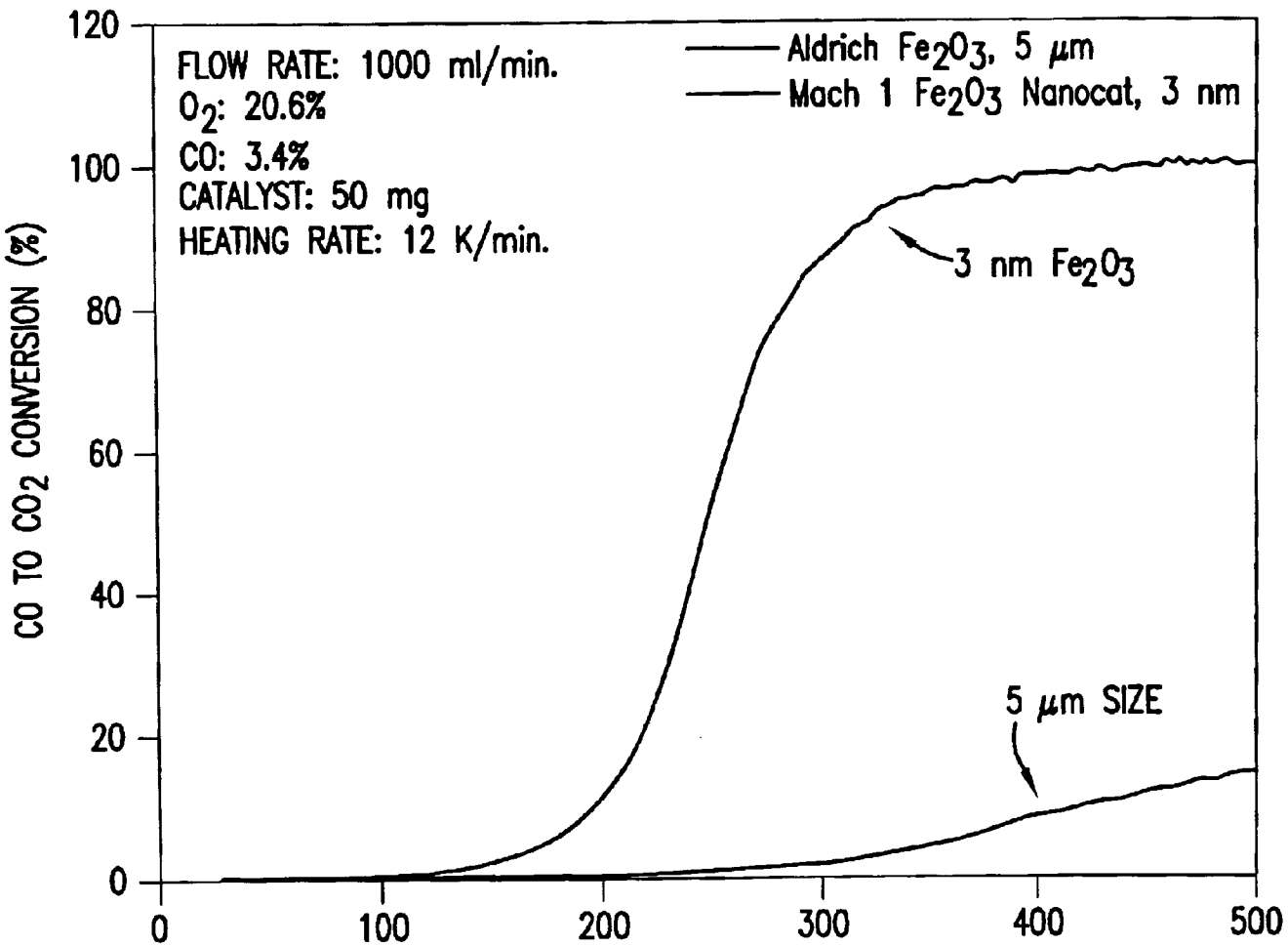
FIG. 9 depicts a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 $\mu$m.

FIG. 9 shows a comparison between the catalytic activity of $Fe_2O_3$ nanoparticles (NANOCAT® Superfine Iron Oxide (SFIO) from MACH I, Inc., King of Prussia, Pa.) having an average particle size of about 3 nm, versus $Fe_2O_3$ powder (from Aldrich Chemical Company) having an average particle size of about 5 $\mu$m. The $Fe_2O_3$ nanoparticles show a much higher percentage of conversion of carbon monoxide to carbon dioxide than the $Fe_2O_3$ having an average particle size of about 5 $\mu$m. Such results may also be achieved using FeOOH particles that decompose during smoking to produce $Fe_2O_3$ nanoparticles in situ.

Figure 10:
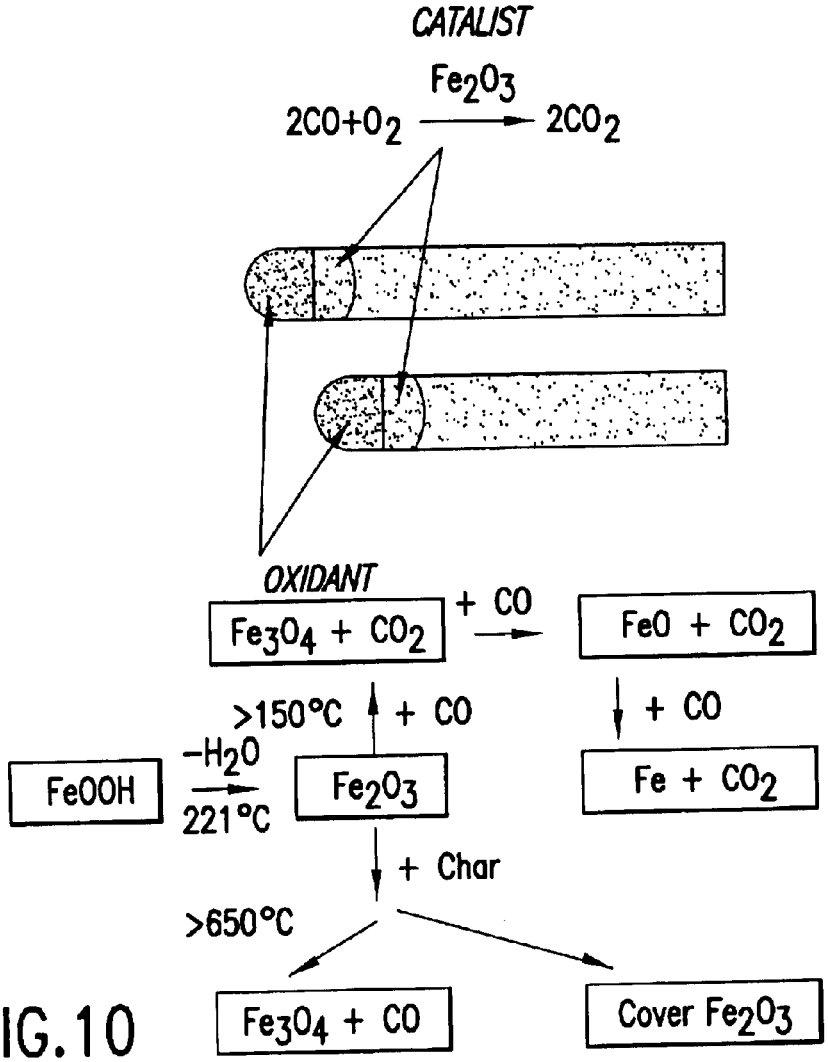
FIG. 10 depicts the combustion zone of a cigarette during smoking (where the $Fe_2O_3$ nanoparticles act as an oxidant) and the pyrolysis region of a cigarette during smoking (where the $Fe_2O_3$ nanoparticles act as a catalyst), as well as the relevant reactions that occur in those regions.
Figure 11A:
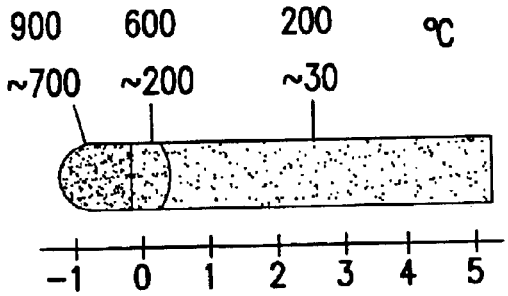
FIG. 11A depicts the combustion zone, the pyrolysis/distillation zone, and the condensation/filtration zone.
Figure 11B:
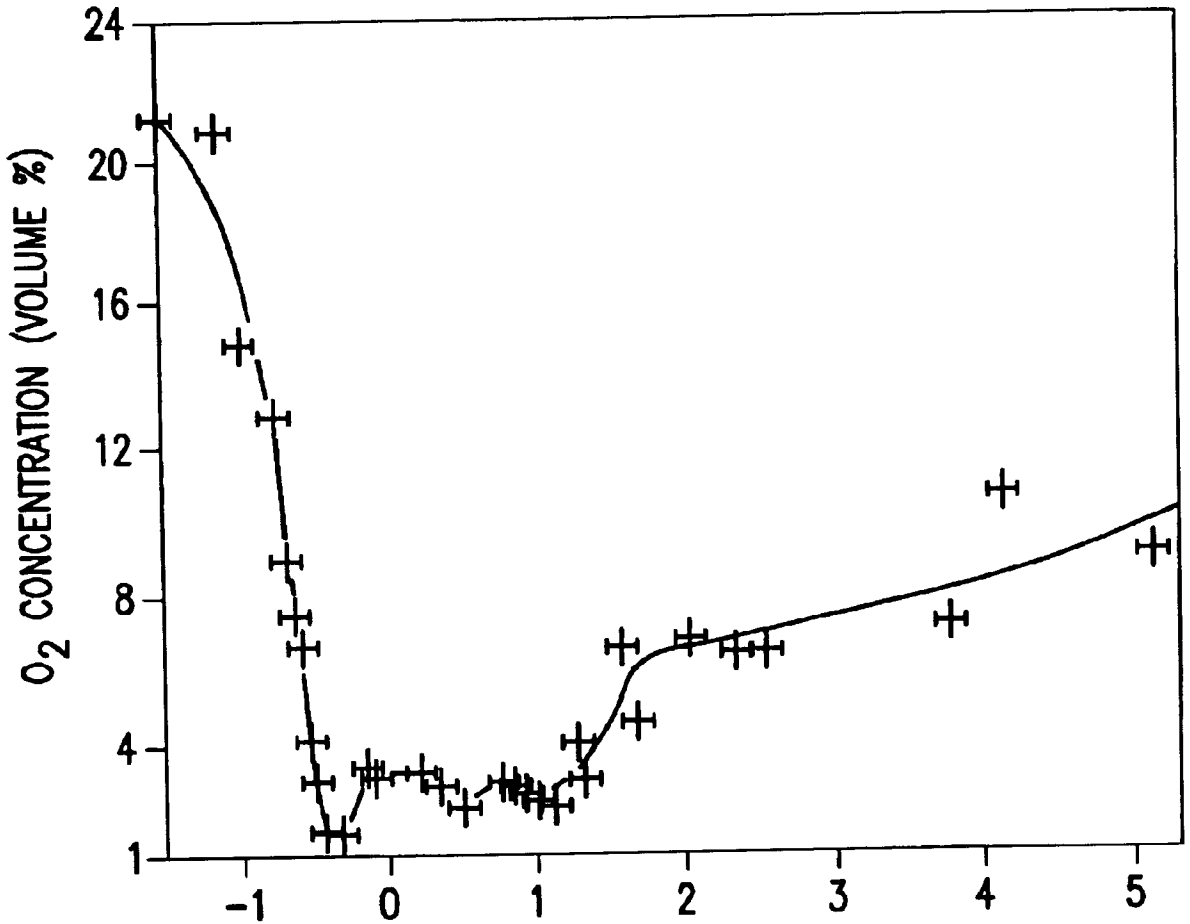
FIGS. 11B, 11C and 11D depict the relative levels of oxygen, carbon dioxide and carbon monoxide respectively, along the length of the cigarette during smoking.
Figure 11C:
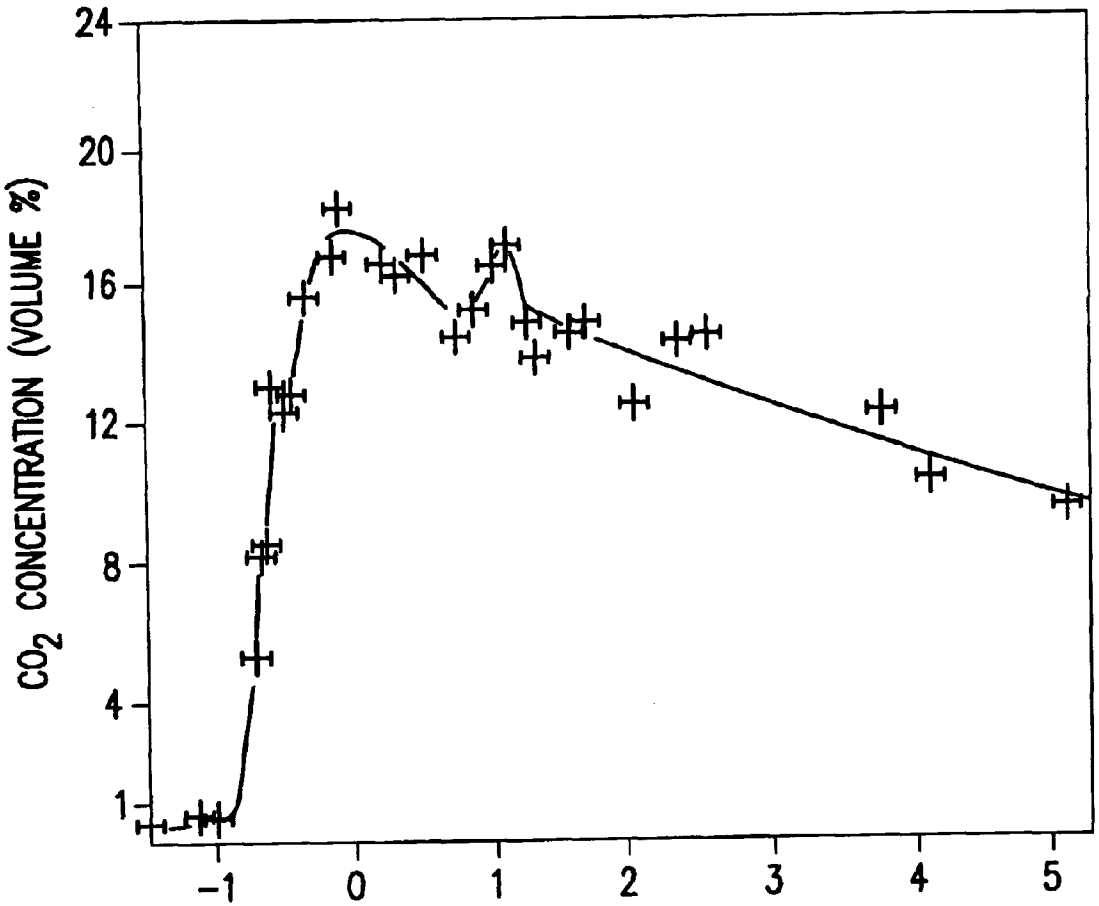
Figure 11D:
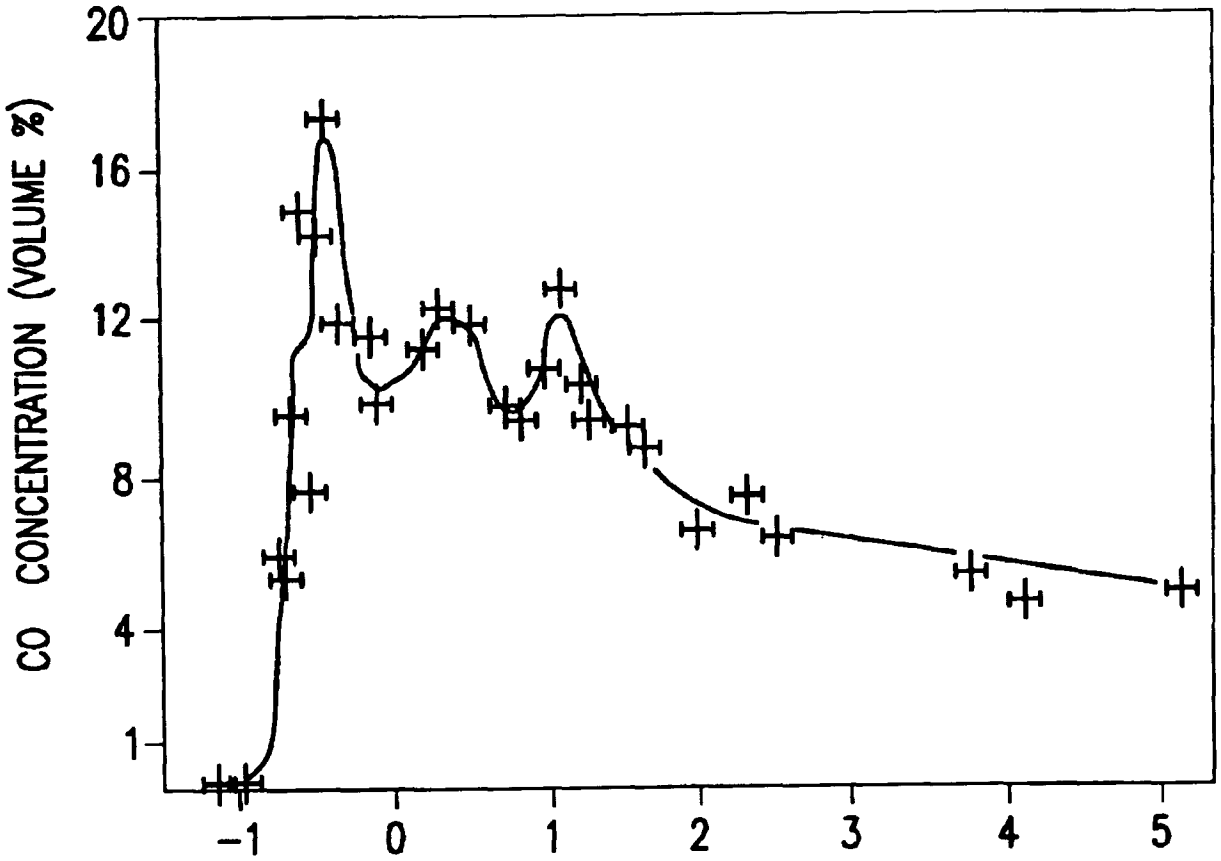

As shown schematically in FIG. 10, the $Fe_2O_3$ nanoparticles act as a catalyst in the pyrolysis zone, and act as an oxidant in the combustion region. FIG. 11A shows various temperature zones in a lit cigarette, and FIGS. 11B, 11C and 11D show the respective amounts of oxygen, carbon dioxide and carbon monoxide in each region of the cigarette during smoking. The oxidant/catalyst dual function and the reaction temperature range make $Fe_2O_3$ a preferred oxidant/catalyst to be generated in situ. Also, during the smoking of the cigarette, the $Fe_2O_3$ may be used initially as a catalyst (i.e. in the pyrolysis zone), and then as an oxidant (i.e. in the combustion region).

Various experiments to further study thermodynamic and kinetics of various catalysts were conducted using a quartz flow tube reactor. The kinetics equation governing these reactions is as follows:

$$\ln(1-x)=-A_o e^{-(Ea/RT)}\cdot(s\cdot l/F)$$

where the variables are defined as follows:

x=the percentage of carbon monoxide converted to carbon dioxide $A_o$=the pre-exponential factor, $5\times10^{-6}$ $s^{-1}$ R=the gas constant, $1.987\times10^{-3}$ kcal/(mol·K)

Figure 12:
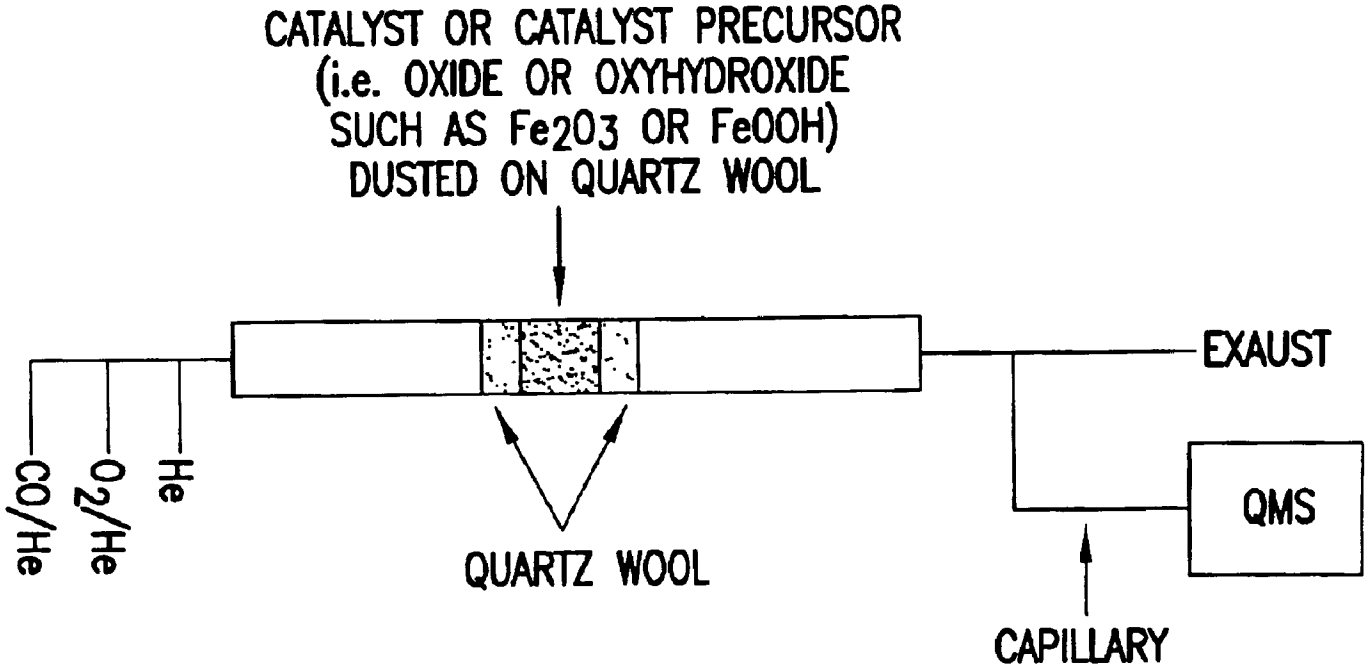
FIG. 12 depicts a schematic of a quartz flow tube reactor.

$E_a$=activation energy, 14.5 kcal/mol s=cross section of the flow tube, 0.622 $cm^2$ l=length of the catalyst, 1.5 cm F=flow rate, in $cm^3/s$ A schematic of a quartz flow tube reactor, suitable for carrying out such studies, is shown in FIG. 12. Helium, oxygen/helium and/or carbon monoxide/helium mixtures may be introduced at one end of the reactor. A quartz wool dusted with catalyst or catalyst precursor, such as $Fe_2O_3$ or FeOOH, is placed within the reactor. The products exit the reactor at a second end, which comprises an exhaust and a capillary line to a Quadrupole Mass Spectrometer ("QMS"). The relative amounts of products can thus be determined for a variety of reaction conditions.

Figure 13:
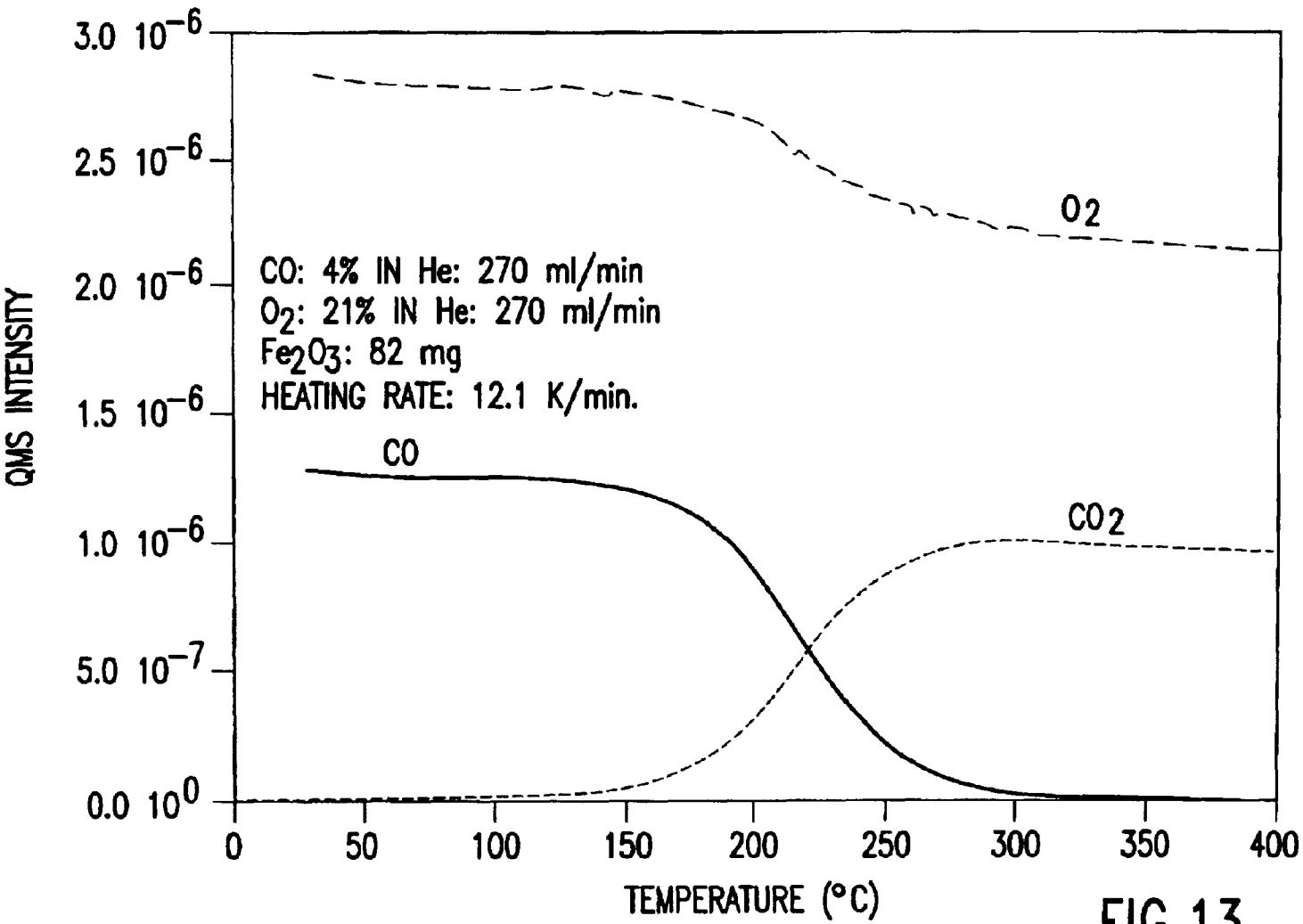
FIG. 13 depicts the temperature dependence on the production of carbon monoxide, carbon dioxide and oxygen, when using $Fe_2O_3$ nanoparticles as the catalyst for the oxidation of carbon monoxide by oxygen to produce carbon dioxide.

FIG. 13 is a graph of temperature versus QMS intensity for a test wherein $Fe_2O_3$ nanoparticles are used as a catalyst for the reaction of carbon monoxide with oxygen to produce carbon dioxide. In the test, about 82 mg of $Fe_2O_3$ nanoparticles are loaded in the quartz flow tube reactor. Carbon monoxide is provided at 4% concentration in helium at a flow rate of about 270 mL/min, and oxygen is provided at 21% concentration in helium at a flow rate of about 270 mL/min. The heating rate is about 12.1 K/min. As shown in this graph, $Fe_2O_3$ nanoparticles are effective at converting carbon monoxide to carbon dioxide at temperatures above around 225° C.

Figure 14:
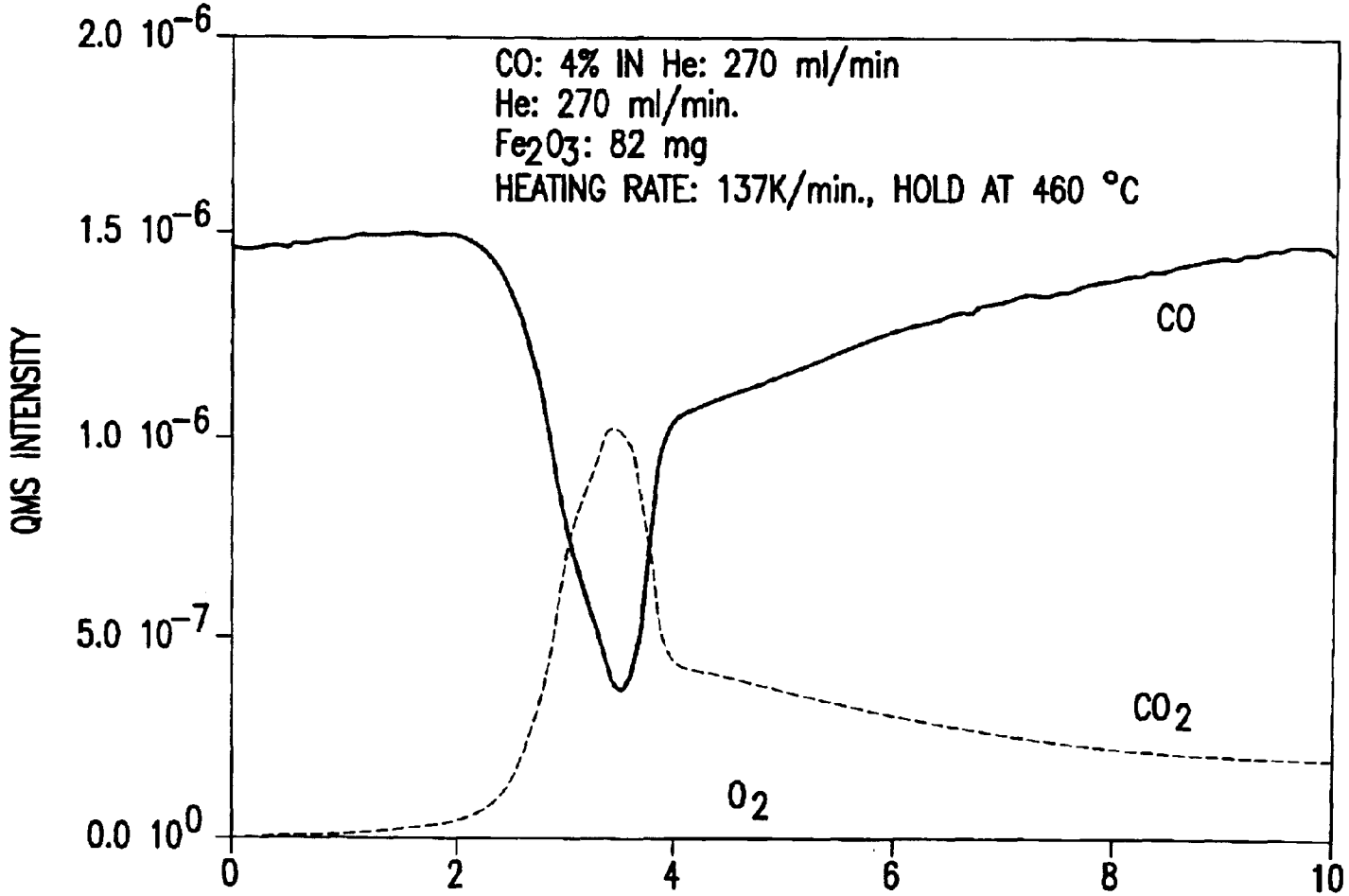
FIG. 14 illustrates the relative production of carbon monoxide, carbon dioxide and oxygen, when using $Fe_2O_3$ nanoparticles as an oxidant for the reaction of $Fe_2O_3$ with carbon monoxide to produce carbon dioxide and FeO.

FIG. 14 is a graph of time versus QMS intensity for a test wherein $Fe_2O_3$ nanoparticles are studied as an oxidant for the reaction of $Fe_2O_3$ with carbon monoxide to produce carbon dioxide and FeO. In the test, about 82 mg of $Fe_2O_3$ nanoparticles are loaded in the quartz flow tube reactor. Carbon monoxide is provided at 4% concentration in helium at a flow rate of about 270 mL/min, and the heating rate is about 137 K/min to a maximum temperature of 460° C. As suggested by data shown in FIGS. 13 and 14, $Fe_2O_3$ nanoparticles are effective in conversion of carbon monoxide to carbon dioxide under conditions similar to those during smoking of a cigarette.

Figure 15A:
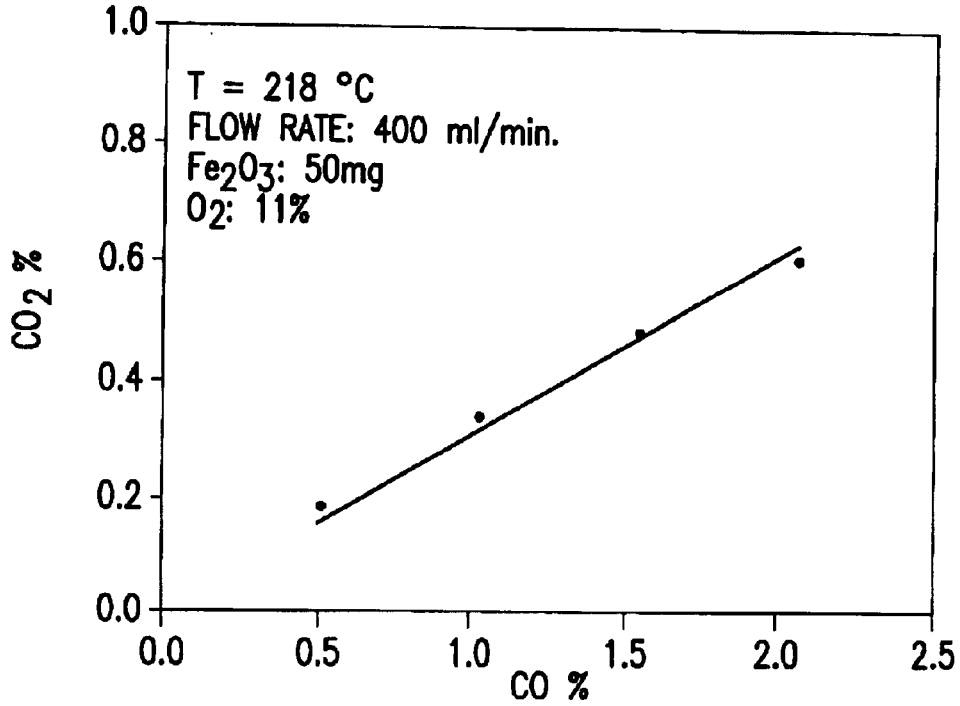
FIGS. 15A and 15B illustrate the reaction orders of carbon monoxide and carbon dioxide with $Fe_2O_3$ as a catalyst.
Figure 15B:
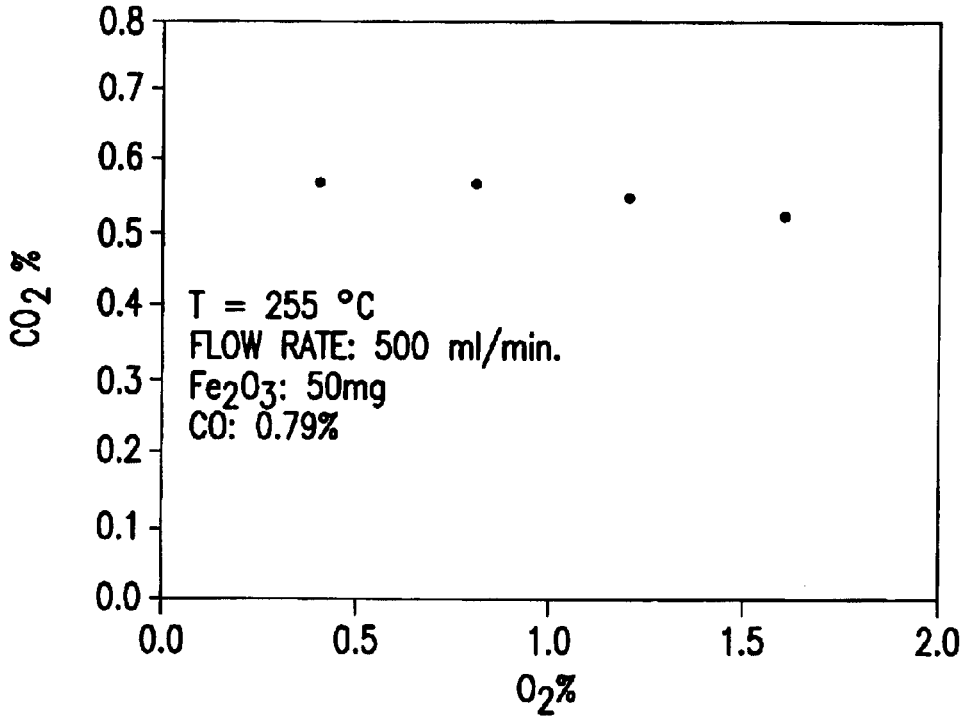
Figure 16:
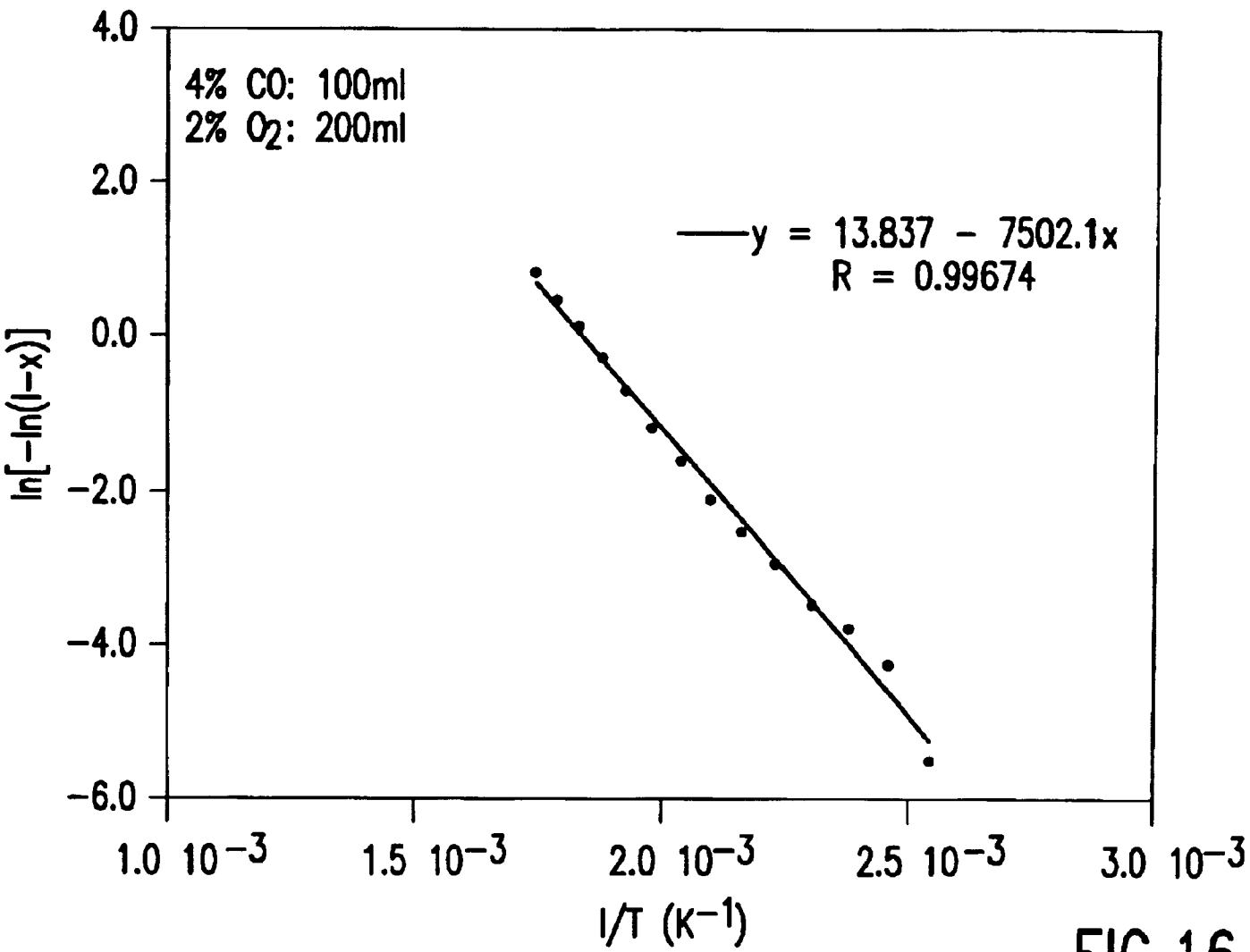
FIG. 16 depicts the measurement of the activation energy and the pre-exponential factor for the reaction of carbon monoxide with oxygen to produce carbon dioxide, using $Fe_2O_3$ nanoparticles as a catalyst for the reaction.

FIGS. 15A and 15B are graphs showing the reaction orders of carbon monoxide and carbon dioxide with $Fe_2O_3$ as a catalyst. FIG. 16 depicts the measurement of the activation energy and the pre-exponential factor for the reaction of carbon monoxide with oxygen to produce carbon dioxide, using $Fe_2O_3$ nanoparticles as a catalyst for the reaction. A summary of activation energies is provided in Table 2.

TABLE 2

Summary of the Activation Energies and Pre-exponential Factors

| | Flow Rate (mL/min) | CO % | $O_2$ % | $A_0$ ($s^{-1}$) | $E_a$ (kcal/mol) |
|---|---|---|---|---|---|
| 1 | 300 | 1.32 | 1.34 | $1.8\times10^7$ | 14.9 |
| 2 | 900 | 1.32 | 1.34 | $8.2\times10^6$ | 14.7 |
| 3 | 1000 | 3.43 | 20.6 | $2.3\times10^6$ | 13.5 |
| 4 | 500 | 3.43 | 20.6 | $6.6\times10^6$ | 14.3 |
| 5 | 250 | 3.42 | 20.6 | $2.2\times10^7$ | 15.3 |
| AVG. | | | | $5\times10^6$ | 14.5 |
| Ref. | | | | | |
| 1 | Gas Phase | | | | 39.7 |
| 2 | 2% $Au/TiO_2$ | | | | 7.6 |
| 3 | 2.2% $Pd/Al_2O_3$ | | | | 9.6 |

Figure 17:
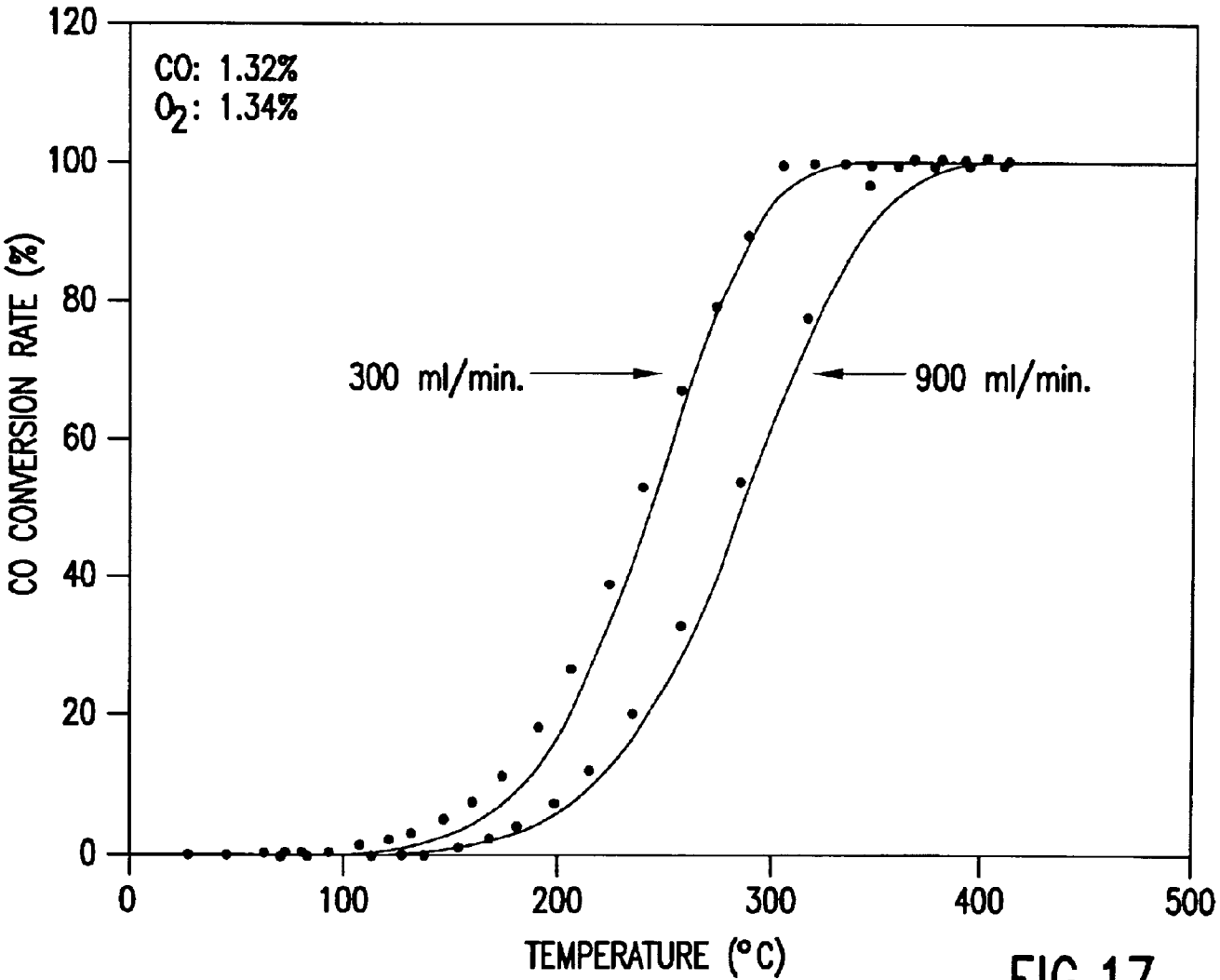
FIG. 17 depicts the temperature dependence for the conversion rate of carbon monoxide, for flow rates of 300 mL/min and 900 mL/min respectively.

FIG. 17 depicts the temperature dependence for the conversion rate of carbon monoxide using 50 mg $Fe_2O_3$ nanoparticles as catalyst in the quartz tube reactor, for flow rates of 300 mL/min and 900 mL/min respectively.

Figure 18:
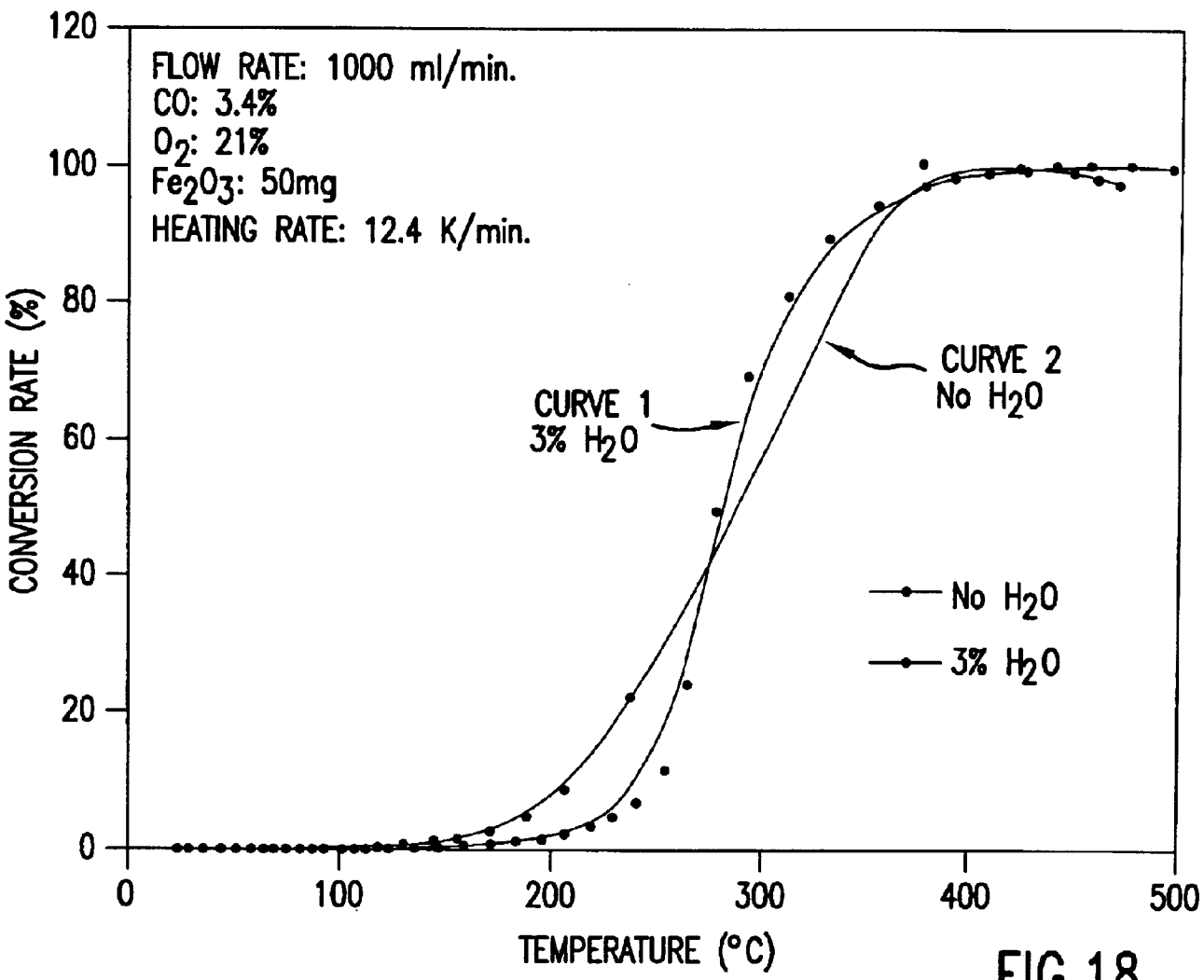
FIG. 18 depicts contamination and deactivation studies for water wherein curve 1 represents the condition for 3% $H_2O$ and curve 2 represents the condition for no $H_2O$.

FIG. 18 depicts contamination and deactivation studies for water using 50 mg $Fe_2O_3$ nanoparticles as catalyst in the quartz tube reactor. As can be seen from the graph, compared to curve 1 (without water), the presence of up to 3% water (curve 2) has little effect on the ability of $Fe_2O_3$ nanoparticles to convert carbon monoxide to carbon dioxide.

Figure 19:
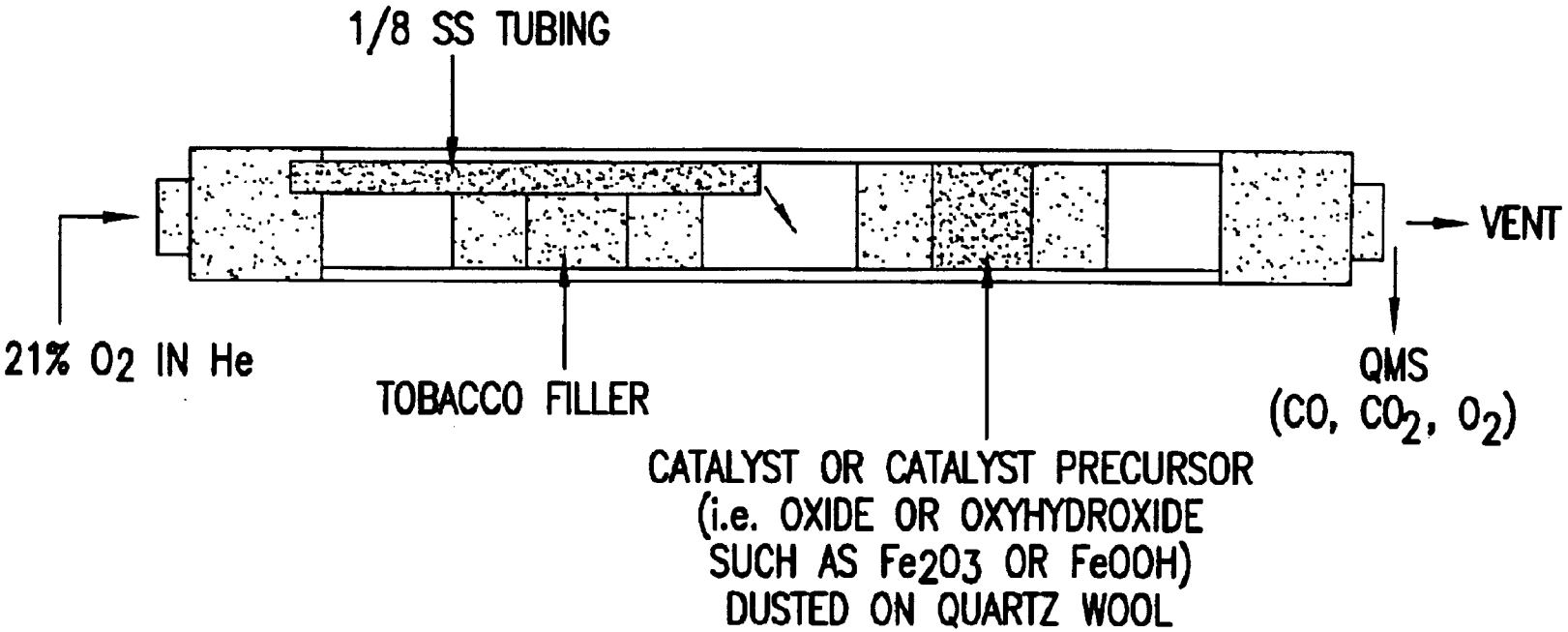
FIG. 19 depicts a flow tube reactor setup to simulate a cigarette in evaluating different catalysts and catalyst precursors.

FIG. 19 shows a flow tube reactor to simulate a cigarette in evaluating different nanopaticle catalysts. Table 3 shows a comparison between the ratio of carbon monoxide to carbon dioxide, and the percentage of oxygen depletion when using $Al_2O_3$ and $Fe_2O_3$ nanoparticles.

TABLE 3

Comparison between $Al_2O_3$, and $Fe_2O_3$ nanoparticles

| Nanoparticle | $CO/CO_2$ | $O_2$ Depletion (%) |
|---|---|---|
| None | 0.51 | 48 |
| $Al_2O_3$ | 0.40 | 60 |
| $Fe_2O_3$ | 0.23 | 100 |

In the absence of nanoparticles, the ratio of carbon monxide to carbon dioxide is about 0.51 and the oxygen depletion is about 48%. The data in Table 3 illustrates the improvement obtained by using nanoparticles. The ratio of carbon monoxide to carbon dioxide drops to 0.40 and 0.23 for $A1_2O_3$ and $Fe_2O_3$ nanoparticles, respectively. The oxygen depletion increases to 60% and 100% for $A1_2O_3$ and $Fe_2O_3$ nanoparticles, respectively.

Figure 20:
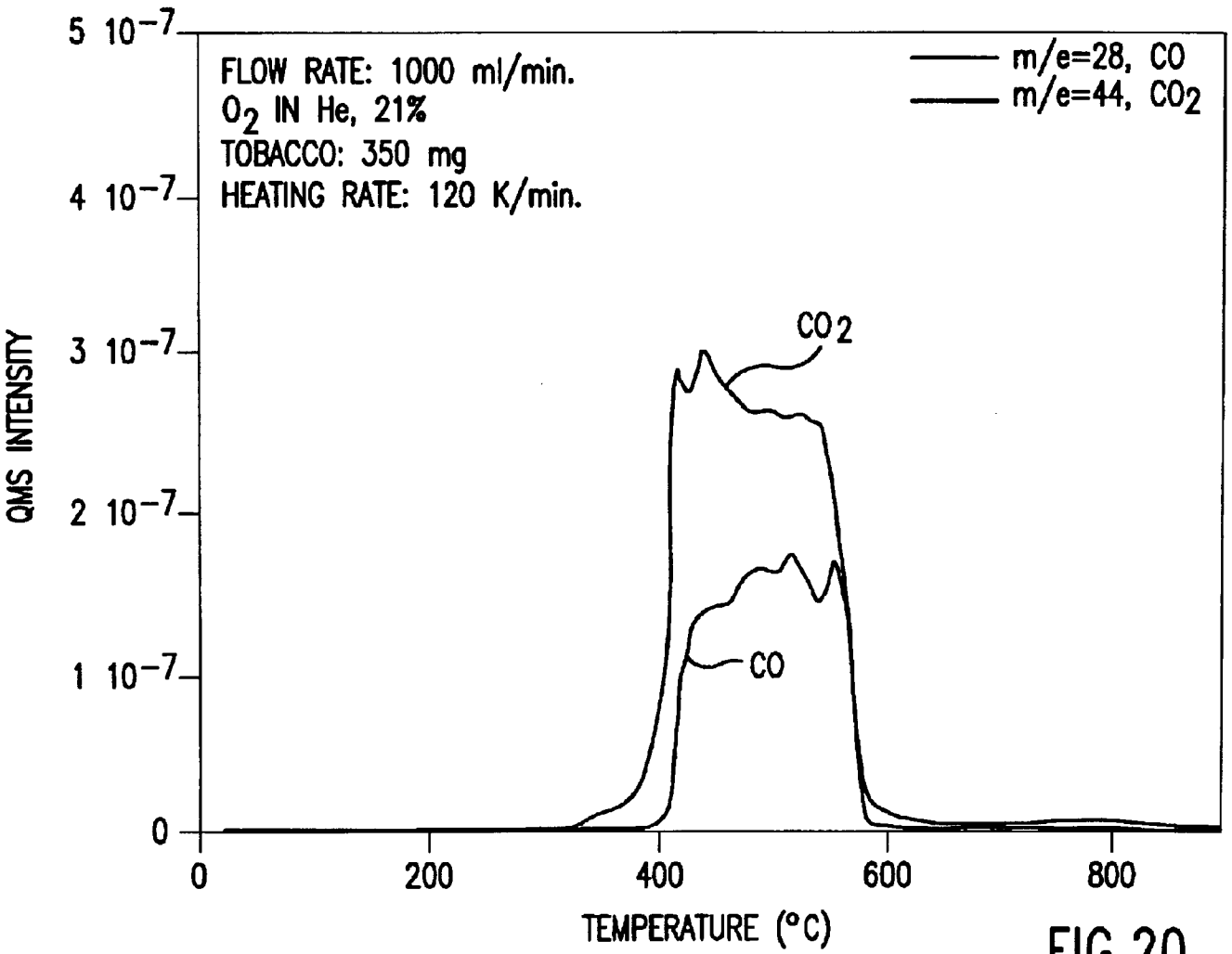
FIG. 20 depicts the relative amounts of carbon monoxide and carbon dioxide production without a catalyst present.
Figure 21:
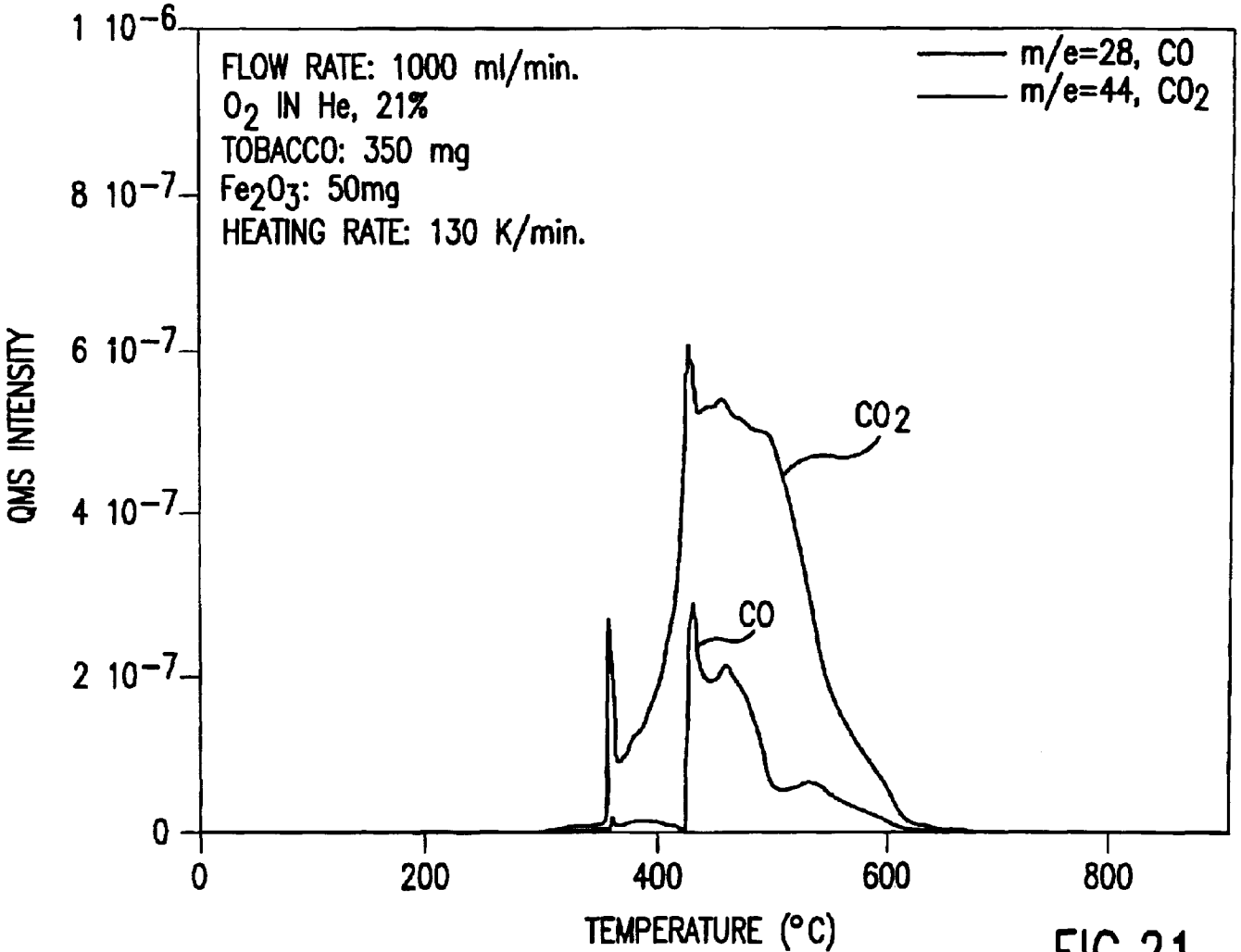
FIG. 21 depicts the relative amounts of carbon monoxide and carbon dioxide production with a $Fe_2O_3$ nanoparticle catalyst present.

FIG. 20 is a graph of temperature versus QMS intensity in a test which shows the amounts of carbon monoxide and carbon dioxide production without a catalyst present. FIG. 21 is a graph of temperature versus QMS intensity in a test which shows the amounts of carbon monoxide and carbon dioxide production when using $Fe_2O_3$ nanoparticles as a catalyst. As can be seen by comparing FIG. 20 and FIG. 21, the presence of $Fe_2O_3$ nanoparticles increases the ratio of carbon dioxide to carbon monoxide present, and decreases the amount of carbon monoxide present.

The oxyhydroxide compounds, as described above, may be provided along the length of a tobacco rod by distributing the oxyhydroxide compounds on the tobacco or incorporating them into the cut filler tobacco using any suitable method. The oxyhydroxide compounds may be provided in the form of a powder or in a solution in the form of a dispersion, for example. In a preferred method, the oxyhydroxide compounds in the form of a dry powder are dusted on the cut filler tobacco. The oxyhydroxide compounds may also be present in the form of a solution or dispersion, and sprayed on the cut filler tobacco. Alternatively, the tobacco may be coated with a solution containing the oxyhydroxide compounds. The oxyhydroxide compounds may also be added to the cut filler tobacco stock supplied to the cigarette making machine or added to a tobacco rod prior to wrapping cigarette paper around the cigarette rod.

The oxyhydroxide compounds will preferably be distributed throughout the tobacco rod portion of a cigarette and optionally the cigarette filter. By providing the oxyhydroxide compounds throughout the entire tobacco rod, it is possible to reduce the amount of carbon monoxide throughout the cigarette, and particularly at both the combustion region and in the pyrolysis zone.

The amount of oxyhydroxide compound to be used may be determined by routine experimentation. Preferably, the product formed from the decomposition of the oxyhydroxide during combustion of the cut filler composition is present in an amount effective to convert at least 50% of the carbon monoxide to carbon dioxide. Preferably, the amount of the oxyhydroxide will be from about a few milligrams, for example, 5 mg/cigarette, to about 200 mg/cigarette. More preferably, the amount of oxyhydroxide will be from about 40 mg/cigarette to about 100 mg/cigarette.

One embodiment of the invention relates to a cut filler composition comprising tobacco and at least one oxyhydroxide compound, as described above, which is capable of acting as an oxidant for the conversion of carbon monoxide to carbon dioxide and/or as a catalyst for the conversion of carbon monoxide to carbon dioxide. Any suitable tobacco mixture may be used for the cut filler. Examples of suitable types of tobacco materials include flue-cured, Burley, Md. or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The invention may also be practiced with tobacco substitutes.

In cigarette manufacture, the tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g. burn additives, combustion modifying agents, coloring agents, binders, etc.) known in the art.

Another embodiment of the invention relates to a cigarette comprising a tobacco rod, wherein the tobacco rod comprises cut filler having at least one oxyhydroxide compound, as described above, which is capable of decomposing during smoking to produce a product that is capable of acting as an oxidant for the conversion of carbon monoxide to carbon dioxide and/or as a catalyst for the conversion of carbon monoxide to carbon dioxide. A further embodiment of the invention relates to a method of making a cigarette, comprising (i) adding an oxyhydroxide compound to a cut filler, wherein the oxyhydroxide compound is capable of decomposing during smoking to produce a product that is capable of acting as an oxidant for the conversion of carbon monoxide to carbon dioxide and/or as a catalyst for the conversion of carbon monoxide to carbon dioxide; (ii) providing the cut filler comprising the oxyhydroxide compound to a cigarette making machine to form a tobacco rod; and (iii) placing a paper wrapper around the tobacco rod to form the cigarette.

Techniques for cigarette manufacture are known in the art. Any conventional or modified cigarette making technique may be used to incorporate the oxyhydroxide compounds. The resulting cigarettes can be manufactured to any desired specification using standard or modified cigarette making techniques and equipment. Typically, the cut filler composition of the invention is optionally combined with other cigarette additives, and provided to a cigarette making machine to produce a tobacco rod, which is then wrapped in cigarette paper, and optionally tipped with filters.

The cigarettes of the invention may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, and preferably around 25 mm. The packing density is typically between the range of about 100 mg/cm$^3$ to about 300 mg/cm$^3$, and preferably 150 mg/cm$^3$ to about 275 mg/cm$^3$.

Yet another embodiment of the invention relates to methods of smoking the cigarette described above, which involve lighting the cigarette to form smoke and inhaling the smoke, wherein during the smoking of the cigarette, the oxyhydroxide compound decomposes during smoking to form a compound that acts as an oxidant for the conversion of carbon monoxide to carbon dioxide and/or as a catalyst for the conversion of carbon monoxide to carbon dioxide.

"Smoking" of a cigarette means the heating or combustion of the cigarette to form smoke, which can be inhaled. Generally, smoking of a cigarette involves lighting one end of the cigarette and inhaling the cigarette smoke through the mouth end of the cigarette, while the tobacco contained therein undergoes a combustion reaction. However, the cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or 5,322,075, for example.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A method of making a cigarette, comprising (i) adding an oxyhydroxide compound other than aluminum oxyhydroxide to a cut filler, wherein the oxyhydroxide compound is capable of decomposing during the smoking of the cigarette to form at least one product capable of acting as an oxidant for the conversion of carbon monoxide to carbon dioxide and/or as a catalyst for the conversion of carbon monoxide to carbon dioxide;

(ii) providing the cut filler comprising the oxyhydroxide compound to a cigarette making machine to form a tobacco rod; and (iii) placing a paper wrapper around the tobacco rod to form the cigarette.

2. The method of claim 1, wherein said oxyhydroxide compound is capable of decomposing during smoking of the cigarette to form at least one product capable of acting as both an oxidant for the conversion of carbon monoxide to carbon dioxide and as a catalyst for the conversion of carbon monoxide to carbon dioxide.

3. The method of claim 1, wherein the oxyhydroxide compound and/or the product formed from the decomposition of the oxyhydroxide during combustion of the cut filler composition is in the form of nanoparticles.

4. The method of claim 3, wherein the oxyhydroxide compound used in step (i) and/or the product formed from the decomposition of the oxyhydroxide during smoking of the cigarette has an average particle size less than about 100 nm.

5. The method of claim 4, wherein the oxyhydroxide compound used in step (i) and/or the product formed from the decomposition of the oxyhydroxide during smoking of the cigarette has an average particle size less than about 50 nm.

6. The method of claim 5, wherein the oxyhydroxide compound used in step (i) and/or the product formed from the decomposition of the oxyhydroxide during smoking of the cigarette has an average particle size less than about 5 nm.

7. The method of claim 1, wherein the cigarette produced comprises from about 5 mg to about 200 mg of the oxyhydroxide compound per cigarette.

8. The method of claim 7, wherein the cigarette produced comprises from about 40 mg to about 100 mg of the oxyhydroxide compound per cigarette.

9. The method of claim 1, wherein the oxyhydroxide compound used in step (i) is selected from the group consisting of FeOOH, TiOOH, and mixtures thereof.

10. The method of claim 9, wherein the oxyhydroxide compound used in step (i) is FeOOH.

11. The method of claim 1, wherein the oxyhydroxide compound used in step (i) is capable of decomposing to form at least one product selected from the group consisting of $Fe_2O_3$, $TiO_2$, and mixtures thereof.

12. The method of claim 11, wherein the product formed from the decomposition of the oxyhydroxide during smoking of the cigarette is present in an amount effective to convert at least 50% of the carbon monoxide to carbon dioxide.

13. The method of claim 1, wherein the oxyhydroxide compound is crystalline.

14. The method of claim 1, wherein the product oxidizes and/or catalyzes the conversion of carbon monoxide to carbon dioxide at a temperature greater than about 150° C.

15. The method of claim 1, wherein the product oxidizes and/or catalyzes the conversion of carbon monoxide to carbon dioxide at a temperature of from about 200° C. to 600° C.

* * * * *